US011634922B2

(12) United States Patent
Hayashi et al.

(10) Patent No.: US 11,634,922 B2
(45) Date of Patent: Apr. 25, 2023

(54) LANE ROPE FLOAT

(71) Applicant: GIFU PLASTIC INDUSTRY CO., LTD., Gifu (JP)

(72) Inventors: Hidetoshi Hayashi, Gifu (JP); Hidero Ozawa, Gifu (JP)

(73) Assignee: GIFU PLASTIC INDUSTRY CO., LTD., Gifu (JP)

( * ) Notice: Subject to any disclaimer, the term of this patent is extended or adjusted under 35 U.S.C. 154(b) by 93 days.

(21) Appl. No.: 17/427,232

(22) PCT Filed: Feb. 12, 2020

(86) PCT No.: PCT/JP2020/005249
§ 371 (c)(1),
(2) Date: Feb. 3, 2022

(87) PCT Pub. No.: WO2020/166586
PCT Pub. Date: Aug. 20, 2020

(65) Prior Publication Data

US 2022/0170283 A1 Jun. 2, 2022

(30) Foreign Application Priority Data

Feb. 12, 2019 (JP) ..... JP2019-022896

(51) Int. Cl.
*E04H 4/14* (2006.01)

(52) U.S. Cl.
CPC ..... *E04H 4/143* (2013.01)

(58) Field of Classification Search
CPC ..... E04H 4/143
(Continued)

(56) References Cited

U.S. PATENT DOCUMENTS 11,560,729 B2 * 1/2023 Hayashi ..... E04H 4/143

FOREIGN PATENT DOCUMENTS

CN 2514065 Y 10/2002
CN 105971324 A 9/2016
(Continued)

OTHER PUBLICATIONS

International Search Report dated Mar. 24, 2020, in international patent application No. PCT/JP2020/005249, 6 pages.
(Continued)

*Primary Examiner* — Christine J Skubinna
(74) *Attorney, Agent, or Firm* — Blueshift IP, LLC; Robert Plotkin

(57) ABSTRACT

Provided is a lane rope float that is less likely to cause injuries even when a hand, a foot, or the like of a swimmer collides with the lane rope float. A lane rope float that is attached to a rope via a cylindrical portion to define lanes of a pool and is made of a synthetic resin material, the lane rope float including: a plurality of blades protruding in parallel with the rope around the cylindrical portion; and an outer peripheral wall connected to side end portions of the blades and covering the blades, wherein a groove portion is formed between the side end portion of each of the blades and the outer peripheral wall, wherein a connection end portion of the side end portion of the blade and the outer peripheral wall are connected, and wherein the outer peripheral wall is elastically deformable toward the blades so as to crush the groove portion.

11 Claims, 10 Drawing Sheets

(58) Field of Classification Search
USPC ..... 4/505
See application file for complete search history.

(56) References Cited

FOREIGN PATENT DOCUMENTS

| | | | |
|---|---|---|---|
| JP | 3055245 | U | 1/1999 |
| WO | 2018221710 | A1 | 12/2018 |

OTHER PUBLICATIONS

"[37th] Staff Blog—Where is this?!" 7 pages, by posted online Oct. 8, 2018 at <<https://www.gunzesports.com/suitakento/staff/第37弾スタッフブログ～こんなところに～! >> .
Risu Kogyo co., LTD, New Soft lane ropes "RL-110Y", posted online Jul. 17, 2018 and available on the internet at <URL:https://www.risu.co.jp/group/news/201807171617.html> and presented at SPORTEC 2018 Exhibition—Japan's Largest Exhibition of Sports & Health Industry on Jul. 25, 2018.
Sanritsu Net, "Launch of Course Rope with New Texture!" Dec. 27, 2018, available online at: <https: //pool-fitness.jp/wppost/staff_blog_details.php?postid=I83>.

* cited by examiner (a)

(b)

(a)

(b)

LANE ROPE FLOAT

TECHNICAL FIELD

The present invention relates to a lane rope float installed in a pool or the like.

BACKGROUND ART

Conventionally, various types of lane rope floats have been known. For example, a lane rope float disclosed in Patent Literature 1 includes a cylindrical portion through which a rope is inserted in a central portion, a central plate extending around the cylindrical portion, a plurality of blades protruding from the central plate in parallel with the rope, and an outer peripheral wall connected to surround the blades. Waves created by swimmers in each lane are taken into the lane rope float and dissipated by the blades and the outer peripheral wall.

However, the lane rope float disclosed in Patent Literature 1 has a structure in which the blades and the outer peripheral wall are firmly connected together with the central plate so that the entire lane rope float is hardly deformed, and thus, even when a hand, a foot, or the like of a swimmer collides with the lane rope float, the lane rope float is hardly bent, so that the swimmer may be injured. Therefore, how effectively the lane rope float disclosed in Patent Literature 1 prevents injuries caused by collision of a hand, foot, or the like of a swimmer has not been sufficiently considered.

CITATIONS LIST

Patent Literature

Patent Literature 1: JP 3055245 Utility model

SUMMARY OF INVENTION

Technical Problems

Therefore, in view of the above problems, the present invention provides a lane rope float that less causes injuries even when a hand, a foot, or the like of a swimmer collides with the lane rope float.

Solutions to Problems

In order to solve the above problems, the lane rope float according to claim 1 of the present invention is a lane rope float that is attached to a rope via a cylindrical portion to define lanes of a pool and is made of a synthetic resin material, the lane rope float including:

a plurality of blades protruding in parallel with the rope around the cylindrical portion; and an outer peripheral wall connected to side end portions of the blades, wherein the blades are each provided with a non-connection portion where the adjacent blades are not connected to each other, the non-connection portion extending across a center of the blade and having a length of half or more of the length of the blade, wherein a space is further provided between the adjacent blades along the non-connection portion, and wherein the outer peripheral wall is elastically deformable so as to crush the space.

According to the above characteristic, the non-connection portion of the blade has a length of half or more of the length of the blade, and the non-connection portion extends across the center of the blade, so that most of the vicinity of the center of the blade is not connected to the adjacent blades, and the blade is easily elastically deformed. In addition to the fact that the blade is easily elastically deformed, the space exists between the adjacent blades. Thus, the outer peripheral wall can be easily elastically deformed inward so as to crush the space. Therefore, even when a hand or a foot of a swimmer collides with the outer peripheral wall, the outer peripheral wall is elastically deformed inward so as to crush the space, and absorbs the force at the time of collision, thereby making it possible to prevent the swimmer from being injured.

Further, the lane rope float according to claim 2 of the present invention is a lane rope float that is attached to a rope via a cylindrical portion to define lanes of a pool and is made of a synthetic resin material, the lane rope float including:

a plurality of blades protruding in parallel with the rope around the cylindrical portion; and an outer peripheral wall connected to side end portions of the blades, wherein a groove portion is formed between the side end portion of each of the blades and the outer peripheral wall, wherein a terminal portion of the side end portion of the blade and the outer peripheral wall is connected, and wherein the outer peripheral wall is elastically deformable toward the blade so as to crush the groove portion.

According to the above characteristic, even when a hand or a foot of a swimmer collides with the outer peripheral wall, the outer peripheral wall is elastically deformed inward so as to crush the groove portion, and the blade is also deformable. Thus, it is possible to absorb the force at the time of collision, and to prevent the swimmer from being injured.

Furthermore, a lane rope float according to claim 3 of the present invention is a lane rope float that is attached to a rope via a cylindrical portion to define lanes of a pool and is made of a synthetic resin material, the lane rope float including:

a plurality of blades protruding in parallel with the rope around the cylindrical portion; and an outer peripheral wall connected to side end portions of the blades, wherein a groove portion is formed on the outer peripheral wall at a lateral side of the side end portion of each of the blades, and wherein the outer peripheral wall is elastically deformable toward a center.

According to the above characteristic, the groove portion is provided in the portion on the lateral side of the side end portion of the blade, and thus the outer peripheral wall is more easily elastically deformed inward. Even when a hand or a foot of a swimmer collides with the outer peripheral wall, the outer peripheral wall is elastically deformed inward and absorbs the force at the time of collision. Therefore, it is possible to prevent the swimmer from being injured.

Furthermore, a lane rope float according to claim 4 of the present invention is a lane rope float that is attached to a rope via a cylindrical portion to define lanes of a pool and is made of a synthetic resin material, the lane rope float including:

a plurality of blades protruding in parallel with the rope around the cylindrical portion; and an outer peripheral wall connected to side end portions of the blades, wherein the blades are each formed obliquely with respect to the outer peripheral wall, and wherein the outer peripheral wall is elastically deformable toward the blade.

According to the above characteristic, when the deformed outer peripheral wall presses the blade, the blade is easily deformed together with the outer peripheral wall.

Therefore, even when pressing the blade, the outer peripheral wall can be elastically deformed further inward from that position. Alternatively, when the outer peripheral wall is elastically deformed inward, the blade is elastically deformed toward the adjacent blade. As a result, the outer peripheral wall is easily elastically deformed inward, and even when a hand, a foot, or the like of a swimmer collides with the lane rope float, it is possible to prevent the swimmer from being injured.

Furthermore, a lane rope float according to claim 5 of the present invention is a lane rope float that is attached to a rope via a cylindrical portion to define lanes of a pool and is made of a synthetic resin material, the lane rope float including:

a plurality of blades protruding in parallel with the rope around the cylindrical portion; and an outer peripheral wall connected to side end portions of the blades, wherein an inner connection portion is formed on an inner side of the outer peripheral wall, the inner connection portion being formed such that a width in the vicinity of a center thereof is narrower than both end portions thereof between the adjacent blades, or that the inner connection portion is not formed in the vicinity of the center thereof, and wherein the outer peripheral wall is elastically deformable toward the blades.

According to the above characteristic, the inner connection portion is formed between the adjacent blades such that the width in the vicinity of the center thereof is narrower than the both end portions thereof between the adjacent blades, or that the inner connection portion is not formed in the vicinity of the center thereof. Thus, the outer peripheral wall is easily elastically deformed inward, and, even when a hand, a foot, or the like of a swimmer collides with the lane rope float, it is possible to prevent the swimmer from being injured.

Furthermore, in the lane rope float according to claim 6 of the present invention, the synthetic resin material is soft and has a durometer type A hardness of 10 to 95.

According to the above characteristic, further, the lane rope float is easily elastically deformed, and, even when a hand, a foot, or the like of a swimmer collides with the lane rope float, it is possible to prevent the swimmer from being injured.

Further, the lane rope float according to claim 7 of the present invention is a lane rope float attached to a rope to define lanes of a pool and made of a synthetic resin material, the lane rope float including:

an outer peripheral wall which is elastically deformable, wherein the synthetic resin material is soft and has a durometer type A hardness of 10 to 95.

Therefore, even when a hand or a foot of a swimmer collides with the outer peripheral wall, the outer peripheral wall is elastically deformed inward so as to crush the space, and absorbs the force at the time of collision, thereby making it possible to prevent the swimmer from being injured. Furthermore, when the hardness of the lane rope float as measured by a durometer type A is in the range of 10 to 95, the lane rope float is easily elastically deformed, and, even when a hand, a foot, or the like of a swimmer collides with the lane rope float, it is possible to prevent the swimmer from being injured.

Advantageous Effects of Invention

According to the lane rope float of the present invention, a swimmer is less likely to be injured even when his/her hand, foot, or the like collides with the lane rope float.

REFERENCE SIGNS LIST

100 Lane rope float body
110 Cylindrical portion
120A, 120B Blade
121A, 121B Side end portion
122A, 122B Connection end portion
130A, 130B Outer peripheral wall
160A, 160B Groove portion
300 Lane rope float
R Rope

DESCRIPTION OF EMBODIMENTS

Hereinafter, embodiments of the present invention will be described with reference to the drawings.

Embodiment 1

Figure 1:
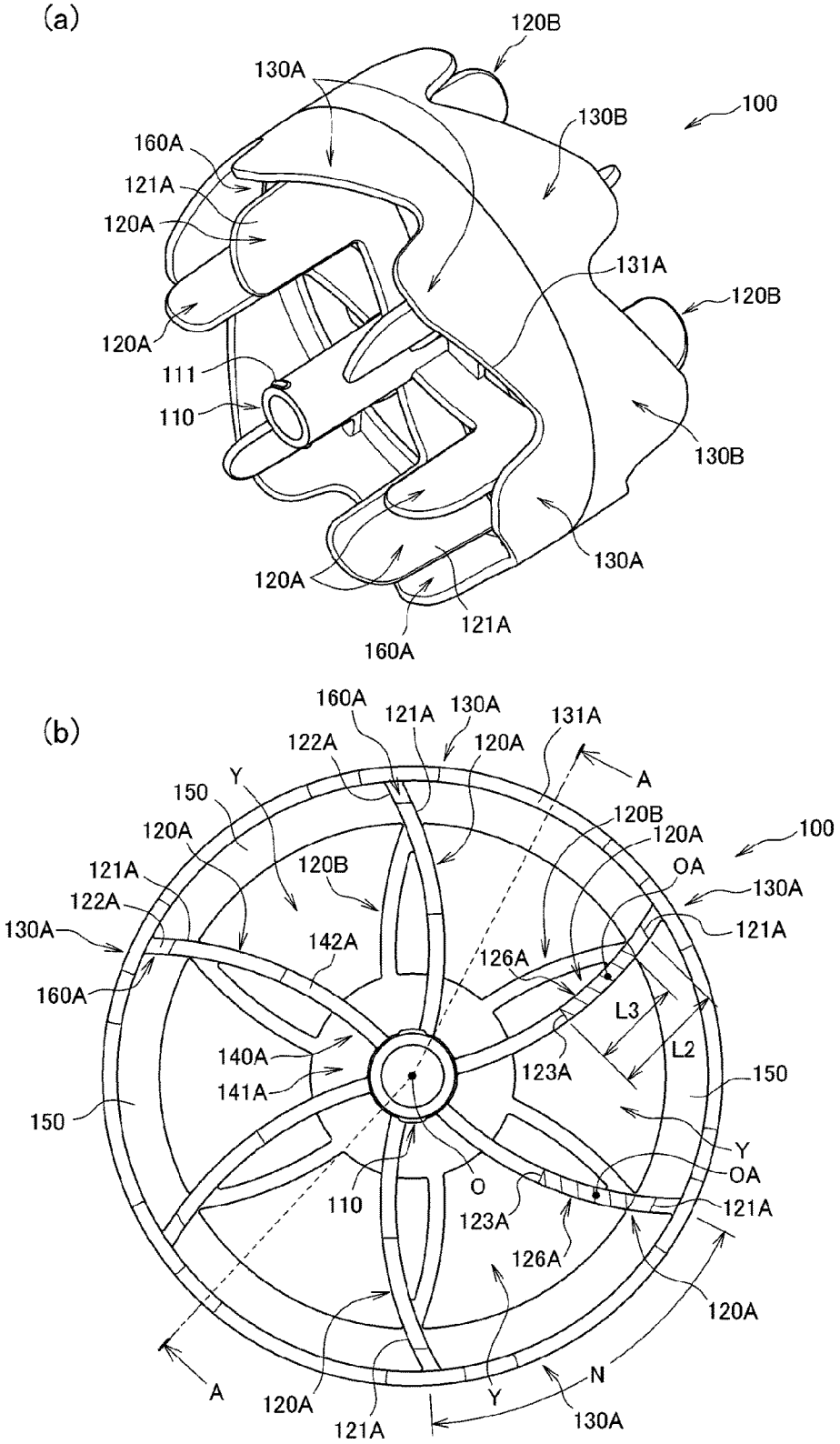
FIG. 1 (*a*) is an overall perspective view of a lane rope float body according to Embodiment 1 of the present invention, and FIG. 1 (*b*) is a front view of the lane rope float body.
Figure 2:
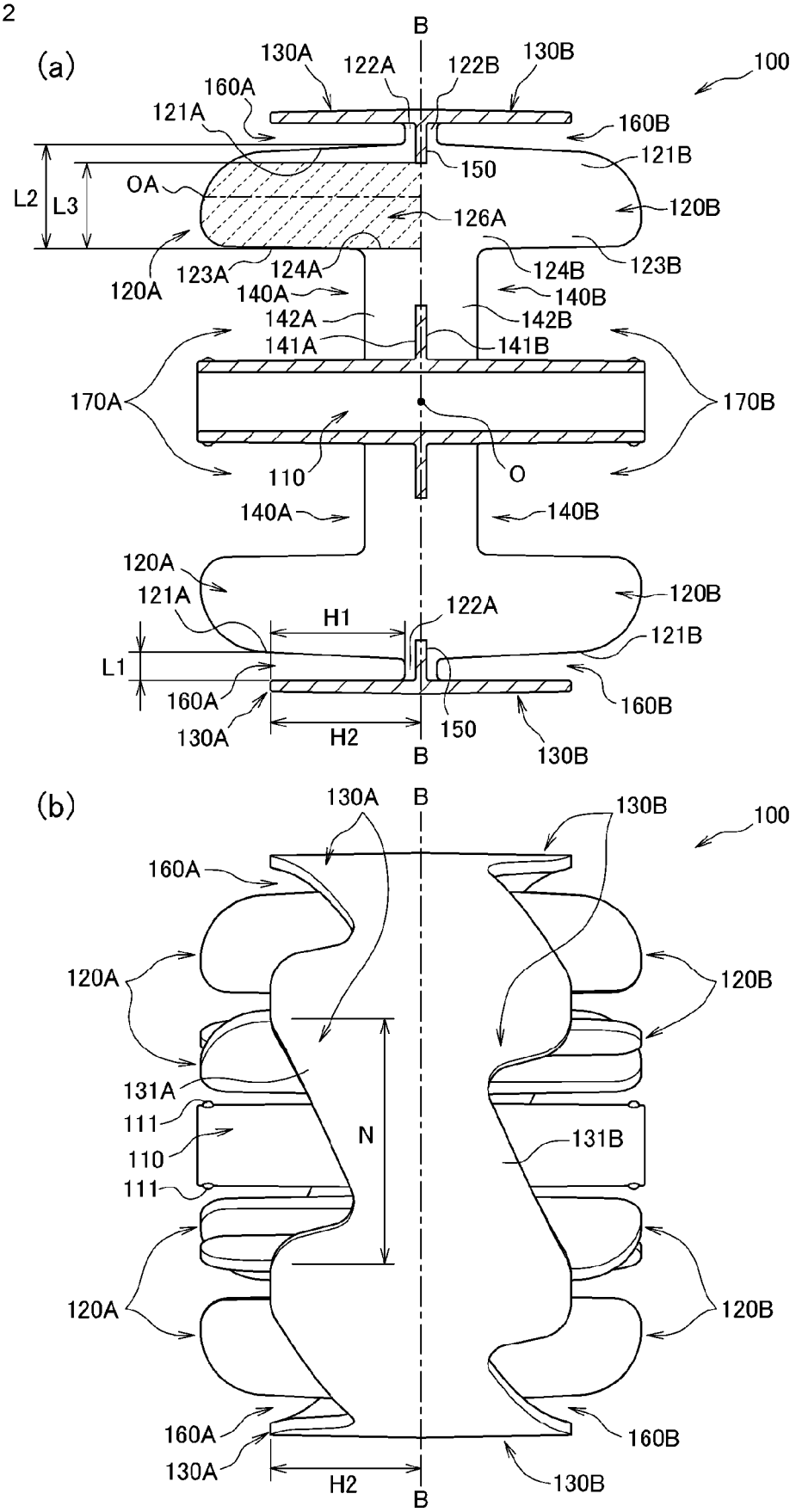
FIG. 2 (*a*) is a cross-sectional view taken along line A-A of FIG. 1 (*b*), and FIG. 2 (*b*) is a side view of the lane rope float body.

First, FIGS. 1 and 2 show a lane rope float body 100 according to Embodiment 1 of the present invention. FIG. 1

(*a*) is an overall perspective view of a lane rope float body 100, FIG. 1 (*b*) is a front view of the lane rope float body 100, FIG. 2 (*a*) is a cross-sectional view taken along line A-A of FIG. 1 (*b*), and FIG. 2 (*b*) is a side view of the lane rope float body 100. A lane rope float 300 which will be described later is composed of the lane rope float body 100 and a float 200, and FIGS. 1 and 2 show a state in which the float 200 is removed from the lane rope float body 100. In addition, the lane rope float 300 of Embodiment 1 is composed of the lane rope float body 100 and the float 200, but the present invention is not limited to this configuration. In a case where the lane rope float body 100 itself has sufficient buoyancy, such as a case where the lane rope float body 100 is molded by foaming, blow-molded, or molded by gas injection or air injection, the float 300 may be composed only of the lane rope float body 100 without the float 200. In addition, even in a case where the lane rope float 300 does not include the float 200 and is composed only of the lane rope float body 100, when lanes of a pool is defined, one float may be provided while a plurality of the lane rope floats 300 are continuously arranged on the rope.

The lane rope float body 100 includes an elongated cylindrical portion 110 positioned at a center of the lane rope float body 100 and through which a rope R can be inserted; a plurality of blades 120A protruding in parallel with the rope R around the cylindrical portion 110; and an outer peripheral wall 130A connected to connection end portions 122A of side end portions 121A of the blades 120A and covering the blades 120A from the side. Note that a fixing claw 111 is formed on a distal end side of the cylindrical portion 110 in order to prevent the float 200 which will be described later from being inadvertently removed when the float 200 is attached.

On an inner side of the outer peripheral wall 130A, a flat plate-shaped inner connection portion 150 extending annularly is formed, and a part of the connection end portion 122A is also connected to the inner connection portion 150. The inner connection portion 150 facilitates restoration of the outer peripheral wall 130A to its original shape when the outer peripheral wall 130A is deformed, and more firmly connects the connection end portions 122A of the blades 120A and the outer peripheral wall 130A. In addition, by providing a notch in the inner connection portion 150, the inner connection portion 150 is easily deformed, and the outer peripheral wall 130A is more easily bent. Furthermore, by making the thickness of the inner connection portion 150 smaller than the thickness of the blades 120A or the outer peripheral wall 130A, the inner connection portion 150 is easily deformed, and the outer peripheral wall 130A is more easily bent.

An outer side of the inner connection portion 150 is directly connected to the adjacent outer peripheral wall 130A, and an inner side of the inner connection portion 150 is not connected to the cylindrical portion 110 except for places connected to the blades 120A and blades 120B, and is in a state of being separated independently of the cylindrical portion 110. Therefore, a large space Y spreads on an inner side of the inner connection portion 150. The outer peripheral wall 130A and the cylindrical portion 110 connected to the inner connection portion 150 are connected by the blades 120A and the blades 120B, but are not connected in other portions and are in a state of being separated by the space Y. Therefore, the inner connection portion 150 is easily deformed, and the outer peripheral wall 130A is easily bent.

As illustrated in FIG. 2 (*a*), terminal portions 124A of the inner end portions 123A of the blades 120A are connected to the cylindrical portion 110 via central connection portions 140A. The central connection portions 140A each includes a flange portion 141A and an erected portion 142A rising from the flange portion 141A in parallel with the cylindrical portion 110. A float space 170A in which the float 200 as will be described later is disposed is formed between each of the blades 120A and the cylindrical portion 110. Since the terminal portion 124A of the blade 120A is connected to the erected portion 142A of the central connection portion 140A, the blade 120A can be reliably returned to the original state parallel to the cylindrical portion 110 even when the blade 120A is deformed so as to fall in the left-right direction.

Further, a groove portion 160A is formed between the side end portion 121A of the blade 120A and the outer peripheral wall 130A, and the side end portion 121A of the blade 120A and the outer peripheral wall 130A are separated from each other. A depth H1 of the groove portion 160A can be set to any depth. For example, the depth H1 may be set to a depth at which a movable range of the outer peripheral wall 130A can be secured so that the outer peripheral wall 130A can be elastically deformed to the front so as not to abut on the side end portion 121A of the blade 120A. However, in the present embodiment, the depth H1 of the groove portion 160A is set to a depth at which the movable range of the outer peripheral wall 130A can be secured so that the outer peripheral wall 130A can be elastically deformed until it abuts on the side end portion 121A of the blade 120A. The depth H1 of the groove portion 160A is equal to a length from a tip of the outer peripheral wall 130A to the connection end portion 122A of the blade 120A.

For example, when the depth H1 of the groove portion 160A is longer than a width L1 of the groove portion 160A, the deformed outer peripheral wall 130A reliably abuts on the side end portion 121A of the blade 120A, and the blade 120A can be directly deformed. Therefore, the entire lane rope float body 100 is more easily bent, and the effect of preventing injuries can be further enhanced.

Further, when the depth H1 of the groove portion 160A is set to at least half or more of a height H2 of the outer peripheral wall 130A adjacent to the groove portion 160A, the outer peripheral wall 130A is easily elastically deformed. In particular, when the depth H1 of the groove portion 160A is set to at least half or more of the height H2 of the outer peripheral wall 130A, the movable range of the outer peripheral wall 130A is greatly expanded, so that most of the outer peripheral wall 130A can directly press the side end portion 121A of the blade 120A. Then, the outer peripheral wall 130A can greatly deform the blade 120A, and thus the entire lane rope float body 100 is more easily bent, and the effect of preventing injuries is further enhanced.

The shape of the groove portion 160A is not limited to the shape as illustrated in FIGS. 1 and 2, and may be any shape as long as the side end portion 121A of the blade 120A and the outer peripheral wall 130A can be separated from each other. In FIGS. 1 and 2, the groove portion 160A is provided in the blade 120A, but the present invention is not limited to this configuration. The groove portion 160A may not be provided in the blade 120A. In this case, the blade 120A may be more easily elastically deformed by forming the blade 120A to be thin (for example, by forming the blade 120A to be thinner than the cylindrical portion 110, by forming the blade 120A to be thinner than the outer peripheral wall 130A, or by forming a thin portion at the position where the groove portion 160A is provided).

As illustrated in FIG. 1 (*b*), the blade 120A is formed obliquely with respect to the outer peripheral wall 130A to which the blade 120A is connected. As will be described later, this allows the outer peripheral wall 130A to be easily elastically deformed inward, and further enhances the effect of preventing injuries. Specifically, the outer peripheral wall 130A, when elastically deformed inward so as to crush the groove portion 160A, eventually abuts on the blade 120A. However, the blade 120A formed obliquely is easily elastically deformed inward, and thus is deformed together with the outer peripheral wall 130A. Therefore, the outer peripheral wall 130A, even when abutting on the blade 120A, can be further easily elastically deformed inward, and, as a result, the effect of preventing injuries is further enhanced. On the other hand, if the blade 120A is formed not obliquely but at a right angle with respect to the outer peripheral wall 130A, the blade 120A is hardly elastically deformed even when pressed by the outer peripheral wall 130A, and hinders the elastic deformation of the outer peripheral wall 130A.

The outer peripheral wall 130A, when elastically deformed inward so as to crush the groove portion 160A, abuts on the blade 120A, so that the blade 120A is elastically deformed together with the outer peripheral wall 130A, but the present invention is not limited to this configuration. Even in a case where the outer peripheral wall 130A does not abut on the blade 120A, the blade 120A is elastically deformed inward via the connection end portion 122A connected to the outer peripheral wall 130A. The blade 120A and the outer peripheral wall 130A are elastically deformed independently of each other.

Further, as illustrated in FIG. 1 (*b*), the blade 120A has a curved shape in a front view. This is because, when the outer peripheral wall 130A is elastically deformed inward so as to crush the groove portion 160A and presses the blade 120A, the blade 120A is easily elastically deformed. In addition, the blade 120A is curved, and thus is easily restored to its original shape after elastic deformation.

In addition, the blade 120A is formed obliquely with respect to the outer peripheral wall 130A and has a curved shape in a front view, but is not limited to the shape, and may have any shape. For example, as long as a radial length of the blade 120A is longer than a radius of the lane rope float body 100 (that is, a length of a straight line from a center of the cylindrical portion 110 to the outer peripheral wall 130A), the blade 120A may have an uneven shape or a wave shape.

On the outer peripheral wall 130A between the adjacent blades 120A, a cut portion 131A cut obliquely from the one adjacent blade 120A toward the other adjacent blade 120A is formed. The outer peripheral wall 100A is more easily elastically deformed by the cut portion 131A. In addition, waves traveling from the side enter the lane rope float body 100 from the cut portion 131A, are confined within a space surrounded by the adjacent blades 120A and the outer peripheral wall 130A, and are forcibly changed in traveling direction. Then, a reaction force due to the waves is applied to the lane rope float body 100, and a turbulent flow is further generated in the lane rope float body 100. As a result, the energy of the waves is consumed and the waves are effectively dissipated. Note that the outer peripheral wall 130A may be more easily elastically deformed by forming the outer peripheral wall 130A to be thin (for example, by forming the outer peripheral wall 130A to be thinner than the cylindrical portion 110, or by forming the outer peripheral wall 130A to be thinner than the blade 120A), in addition to by providing the cut portion 131A. Further, by forming a hole in the outer peripheral wall 130A (for example, by providing a large hole in the outer peripheral wall 130A, or by providing a plurality of small holes), the outer peripheral wall 130A may be more easily elastically deformed.

Note that the cut portion 131A is not limited to the obliquely cut shape, and may have any shape as long as a part of the outer peripheral wall 130A is cut to be easily elastic deformed and waves traveling from the side can enter from the cut portion 131A and be confined within the lane rope float body 100. Further, when a plurality of the lane rope floats arranged continuously are adjacent to each other at the time of defining lanes of a pool, the cut portions 131A of the adjacent lane rope floats have a substantially box shape, a substantially quadrangular shape, a substantially circular shape, or a substantially rhombic shape, and waves can enter the lane rope floats from the adjacent cut portions 131A having such a shape. Furthermore, the outer peripheral wall 130A may be more easily bent by providing a notch in the outer peripheral wall 130A or by reducing the thickness of the outer peripheral wall 130A. In addition, the outer peripheral wall 130A may be more easily bent by making the thickness of the outer peripheral wall 130A thinner than the plate thickness of the blade 120A, or by making the thickness of the outer peripheral wall 130A thinner than the plate thickness of the cylindrical portion 110.

As illustrated in FIG. 2 (*a*), the lane rope float body 100 is divided into a front surface side and a back surface side in a B-B cross section passing through a center point O, and the shapes of the front surface side and the back surface side are point-symmetrical with respect to the center point O. Therefore, the blade 120A, the outer peripheral wall 130A, the central connection portion 140A, the groove portion 160A, and the float space 170A on the front surface side have point-symmetrical shapes, with respect to the center point O, to the blade 120B, an outer peripheral wall 130B, a central connection portion 140B, a groove portion 160B, and a float space 170B on the back surface side. With such a shape, when a plurality of the lane rope floats 300 are continuously installed, the lane rope floats 300 can be continuously installed regardless of the directionality of the lane rope floats 300, and thus convenience is improved. Note that, because of the above point-symmetrical relationship, the blade 120B, the outer peripheral wall 130B, the central connection portion 140B, the groove portion 160B, and the float space 170B on the back surface side provide the same effects as those of the blade 120A, the outer peripheral wall 130A, the central connection portion 140A, the groove portion 160A, and the float space 170A on the front surface side, respectively.

As illustrated in FIGS. 1 (*b*) and 2 (*a*), the connection end portion 122A of the blade 120A on the front surface side and a connection end portion 122B of the blade 120B on the back surface side are connected so as to overlap each other. Therefore, when the outer peripheral wall 130A and the outer peripheral wall 130B are pressed inward and elastically deformed, the pressing force is simultaneously and uniformly applied to the blade 120A and the blade 120B via the connection end portion 122A and the connection end portion 122B. As described above, since a load is uniformly applied to the blade 120A and the blade 120B, it is possible to prevent the load from being concentrated on only one of the blades 120 and being damaged. Furthermore, the blade 120A and the blade 120B are elastically deformed at the same time, and restored to their original shapes at the same time. Therefore, the elastically deformed outer peripheral wall 130A and outer peripheral wall 130B can be reliably restored.

The pressing force is simultaneously and uniformly applied to the blade 120A and the blade 120B, but the present invention is not limited to this configuration. The pressing force may not be simultaneously or uniformly applied to the blade 120A and the blade 120B. Even in this case, the blade 120A and the blade 120B can be elastically deformed individually to absorb the force and prevent damage.

In addition, since the connection end portion 122A of the blade 120A on the front surface side and the connection end portion 122B of the blade 120B on the back surface side are connected so as to overlap each other, a distance of a section N where the outer peripheral walls 130 and the blades 120 are not connected is long as illustrated in FIGS. 1 (*b*) and 2 (*b*). Then, the outer peripheral wall 130A and the outer peripheral wall 130B, in particular, central portions of the outer peripheral wall 130A and the outer peripheral wall 130B in the section N are more easily bent inward, so that the effect of preventing injuries can be further enhanced.

In addition, as illustrated in FIG. 1 (*b*), the blade 120A on the front surface side and the blade 120B on the back surface side are brought close to each other, thereby making it possible to prevent a finger or the like from entering a gap between the blade 120A and the blade 120B. A length of this gap is shorter than that of the cylindrical portion 110. Further, since the space Y inside the lane rope float body 100 is widened by bringing the blade 120A on the front surface side and the blade 120B on the back surface side close to each other, the entire lane rope float body 100 is more easily bent, and the effect of preventing injuries can be further enhanced.

In addition, since a member for connecting the adjacent blades 120 is not provided, the space Y inside the lane rope float body 100 is widened, the entire lane rope float body 100 is more easily bent, and the effect of preventing injuries can be further enhanced.

As illustrated in FIG. 1, the inner end portion 123A of each blade 120A is connected to the cylindrical portion 110 via the central connection portion 140A. The adjacent blades 120A are connected to each other by the inner connection portion 150 on the side end portion 121A side. Therefore, in the blade 120A, a non-connection portion 126A where the adjacent blades 120A are not connected to each other is a portion from the inner end portion 123A to the inner connection portion 150 (see hatched portions in FIG. 1 (*b*) and a dotted portion in FIG. 2 (*a*)).

A length of the blade 120A in a direction from the cylindrical portion 110 side toward the outer peripheral wall 130A (in other words, in a radial direction of the lane rope float body 100) is a length L2 from the inner end portion 123A to the side end portion 121A, and a length of the non-connection portion 126A in a direction from the cylindrical portion 110 side toward the outer peripheral wall 130A is a length L3 from the inner end portion 123A to the inner connection portion 150. The length L3 of the non-connection portion 126A is half or more of the length L2 of the blade 120A. Further, the non-connection portion 126A extends from the inner end portion 123A side toward the inner connection portion 150 side across a center of the length L2 of the blade 120A, that is, a center OA of the blade 120A.

As described above, the length L3 of the non-connection portion 126A of the blade 120A is half or more of the length L2 of the blade 120A, and the non-connection portion 126A extends across the center OA of the blade 120A, so that most of the vicinity of the center of the blade 120A is in an independent state of being not connected to the adjacent blades 120A. Therefore, the blade 120A is easily elastically deformed.

Furthermore, as illustrated in FIG. 1 (*b*), the space Y is provided between the adjacent blades 120A along the non-connection portion 126A. Since the space Y is provided along the non-connection portion 126A, there is no portion connecting the adjacent blades 120A in the space Y. In addition to the fact that the blades 120A are easily elastically deformed as described above, the space Y exists between the adjacent blades 120A, and thus the outer peripheral wall 130A can be easily elastically deformed inward so as to crush the space Y. As a result, even when a hand or a foot of a swimmer collides with the outer peripheral wall 130A, the outer peripheral wall 130A is elastically deformed inward so as to crush the space Y and absorbs the force at the time of collision, thereby making it possible to prevent the swimmer from being injured.

The lane rope float body 100 is manufactured by injection molding using a synthetic resin material. The float 200 is blow-molded as will be described later. In the present embodiment, an EVA resin (ethylene-vinyl acetate copolymer resin), polyethylene, LDPE (low density polyethylene), L-LDPE (linear low density polyethylene), metallocene polyethylene, polypropylene, elastomer, styrene elastomer, silicon, or the like is used as the synthetic resin material constituting the lane rope float body 100, but the present invention is not limited to this configuration. Any synthetic resin material can be appropriately adopted as long as the lane rope float body 100 can be elastically deformed.

Here, the lane rope float body 100 can be elastically deformed, so that injuries can be prevented. In order to more effectively prevent injuries, the lane rope float body 100 is desirably made of a soft synthetic resin material so that the lane rope float body 100 can be more easily elastically deformed.

Therefore, the inventors of the present invention have found optimum hardness at which the lane rope float body 100 is easily elastically deformed, through repeated experiments. That is, when hardness of the lane rope float body 100 as measured by the durometer type A is in the range of 10 to 95, the lane rope float body 100 is easily elastically deformed, and, even when a hand, a foot, or the like of a swimmer collides with the lane rope float body 100, it is possible to prevent the swimmer from being injured.

When the hardness of the lane rope float body 100 as measured by the durometer type A is in the range of 75 to 95 (more preferably, the hardness is in the range of 50 to 95), the lane rope float body 100 can be easily elastically deformed, and injuries can be effectively prevented. Furthermore, it is possible to effectively prevent a manufacturing problem that the lane rope float body 100 is not well separated from a mold at the time of injection molding, and a management problem that the lane rope float body 100 loses its shape at the time of storage after molding. The lane rope float 300 may be stored in a state in which the lane rope is wound up or the lane rope float 300 is packed in a storage box.

Furthermore, when the hardness of the lane rope float body 100 as measured by the durometer type A is in the range of 40 to less than 75, the lane rope float body 100 can be easily elastically deformed, and injuries can be effectively prevented. Further, it is possible to effectively prevent a manufacturing problem that the lane rope float body 100 is not well separated from the mold at the time of injection molding.

Furthermore, when the hardness of the lane rope float body 100 as measured by the durometer type A is in the range of 10 to less than 40, the lane rope float body 100 can be easily elastically deformed, and injuries can be effectively prevented.

In a case where the lane rope float body 100 is manufactured using an elastomer, when the hardness of the lane rope float body 100 is in the range of 20 to 95, the lane rope float body 100 can be easily elastically deformed, and injuries can be effectively prevented. Furthermore, it is possible to effectively prevent a manufacturing problem that the lane rope float body 100 is not well separated from a mold at the time of injection molding, and a management problem that the lane rope float body 100 loses its shape at the time of storage after molding. In a case where the lane rope float body 100 is manufactured using an elastomer, when the hardness of the lane rope float body 100 is low, a method of manually releasing the lane rope float body 100 from the mold at the time of injection molding may be adopted. In addition, when the lane rope float 300 is stored in a state of being wound around a reel, the lane rope float 300 is elastically deformed to lose its shape, and a diameter when wound around the reel is reduced, so that a storage space can be reduced. In a case where the lane rope float 300 is reused, when the lane rope float 300 is removed from the reel and stretched in a pool, the lane rope float 300 is restored to its shape (including a case where the lane rope float 300 is restored to its original shape as compared with a case where the lane rope float 300 is stored in a state of being wound around a reel, although the lane rope float 300 may not be completely restored to its original shape).

In a case where the lane rope float body 100 is manufactured using a styrene-based elastomer, the hardness of the lane rope float body 100 is 15. In a case where the lane rope float body is manufactured using silicon, the hardness thereof is 13. However, if the hardness of the lane rope float body 100 is less than 10, the lane rope float body 100 is not well separated from the mold at the time of injection molding, and loses its shape during storage thereof after molding.

When the lane rope float body 100 has low hardness, the following configuration may be adopted in consideration of ease of manufacturing the lane rope float body 100. The lane rope float body 100 as illustrated in FIGS. 1 and 2 is entirely made of a single synthetic resin material. However, for example, the outer peripheral wall 130A and the outer peripheral wall 130B with which a hand, a foot, or the like of a swimmer easily collides may be made of a synthetic resin material such as silicon having low hardness, and the other portions (the cylindrical portion 110, the blade 120A, and the like) may be made of a synthetic resin material such as an EVA resin having higher hardness than that of the outer peripheral wall 130A and the outer peripheral wall 130B. Further, the entire lane rope float body 100 as illustrated in FIGS. 1 and 2 is integrally molded by injection molding. However, for example, the lane rope float body 100 may be manufactured by manufacturing the outer peripheral wall and the remaining portions other than the outer peripheral wall as separate bodies, and attaching the outer peripheral wall so as to be wound around the remaining portions other than the outer peripheral wall from the outside.

The hardness of the lane rope float body 100 described above is obtained by cutting out a part of the lane rope float body 100 (for example, arbitrary places such as the outer peripheral wall 130 and the blade 120) after molding as a test piece, and measuring the hardness of the test piece by the durometer type A in accordance with JIS K6253-3. JIS K6253-3 corresponds to ISO 7619-1.

In addition, when a bending elastic modulus (unit: MPa) of the lane rope float body 100 is in the range of 10 to 200, preferably in the range of 30 to 120, it is possible to more effectively prevent a manufacturing problem that the lane rope float body 100 is not well separated from the mold at the time of injection molding, and a management problem that the lane rope float body 100 loses its shape at the time of storage after molding. Further, the lane rope float body 100 is easily elastically deformed, and, even when a hand, a foot, or the like of a swimmer collides with the lane rope float body 100, it is possible to prevent the swimmer from being injured. In order to further provide the above effects, the bending elastic modulus of the material for molding the lane rope float body 100 is preferably "in the range of 10 to 80, preferably 20 to 50" in the case of silicon, "in the range of 30 to 120, preferably 40 to 100, more preferably 60 to 90" in the case of a material containing an elastomer/rubber component, "in the range of 90 to 160, preferably 100 to 150, more preferably 100 to 130" in the case of low density polyethylene, "in the range of 20 to 120, preferably 20 to 100, more preferably 20 to 90" in the case of a material containing ethylene, and "in the range of 40 to 120, preferably 60 to 100, more preferably 80 to 100" in the case of an EVA resin (ethylene-vinyl acetate copolymer resin). The bending elastic modulus of the lane rope float body 100 was measured by a test method in accordance with JIS K6924-2. JIS K6924-2 corresponds to ISO 4613-2.

In addition, when the lane rope float body 100 is compressed from the outside of the outer peripheral wall toward the center, when compressive strength when the diameter of the lane rope float body 100 is compressed by 5 mm (or 4.6%) is 100N (kg·m/s2) or less, preferably 50N or less, more preferably 30N or less, the lane rope float body 100 is easily elastically deformed, and, even when a hand, a foot, or the like of a swimmer collides with the lane rope float body 100, it is possible to prevent the swimmer from being injured.

Figure 3:
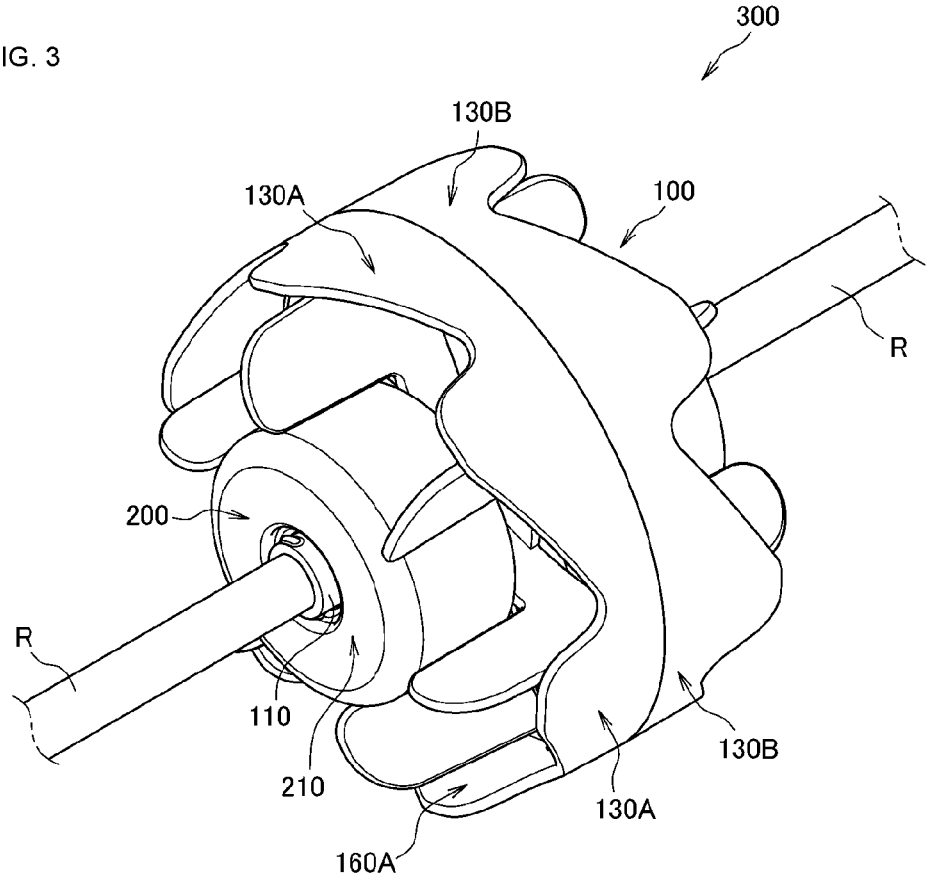
FIG. 3 is an overall perspective view illustrating a usage state of a lane rope float.
Figure 4:
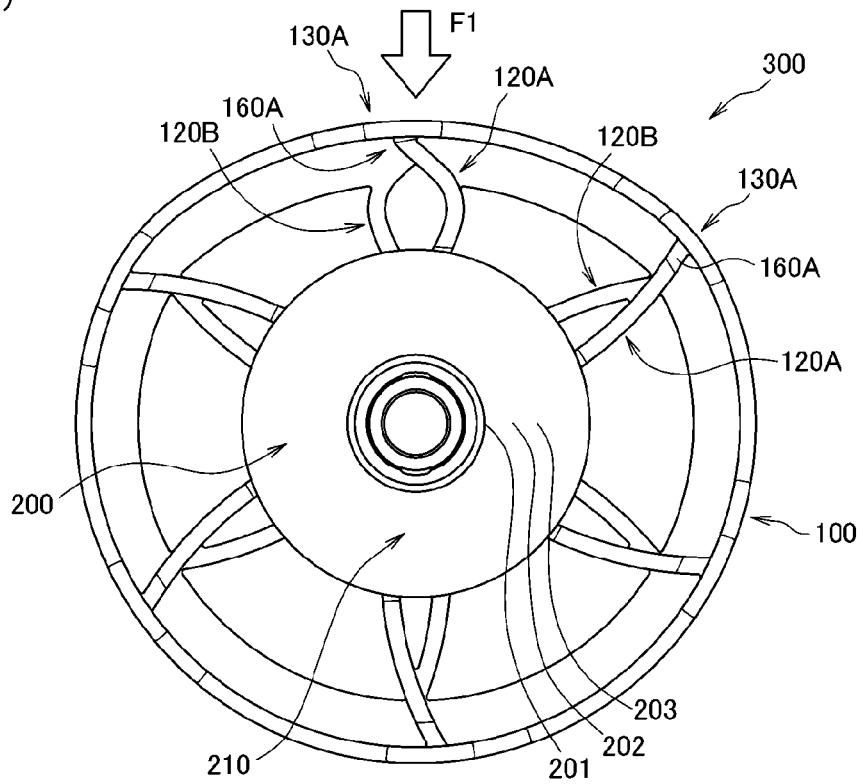
FIGS. 4 (*a*) and 4 (*b*) are front views of the lane rope float, illustrating a state in which an outer peripheral wall and a blade are elastically deformed.
Figure 4:
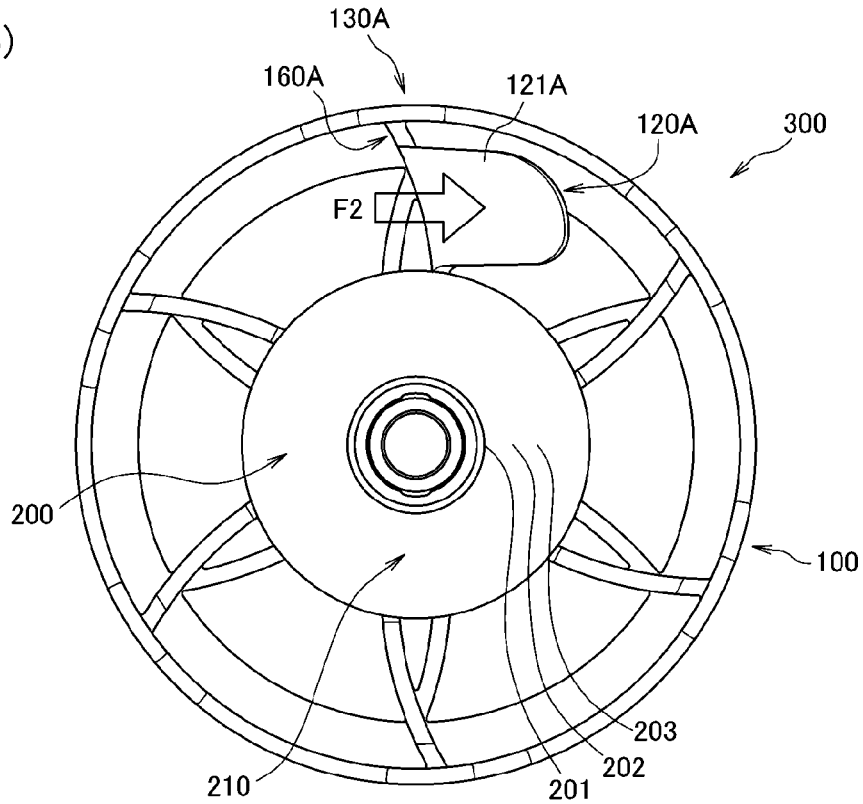

Next, a state in which the float 200 is attached to the lane rope float body 100 to assemble the lane rope float 300, and the rope R is inserted through the lane rope float 300 is illustrated in FIGS. 3 and 4. FIG. 3 is an overall perspective view illustrating a usage state of the lane rope float 300, and FIGS. 4 (*a*) and 4 (*b*) are front views of the lane rope float 300, illustrating a state in which the outer peripheral wall 130A and the blade 120A are elastically deformed.

As illustrated in FIGS. 3 and 4, the annular float 200 is attached to the cylindrical portion 110 of the lane rope float 300. The float 200 is blow-molded using a synthetic resin material, and has a hollow inside. The synthetic resin material constituting the float 200 may be the same as or different from the synthetic resin material constituting the lane rope float body 100, and, for example, a material having higher hardness than that of the synthetic resin material constituting the lane rope float body 100 may be employed. Further, unevennesses may be formed on an outer peripheral surface of the float 200 to increase or decrease bending strength. Further, compressive strength of the float 200 is lower in the order of a place 201 near a cylindrical portion of an outer peripheral surface 210, a place 202 slightly on a center side from the cylindrical portion of the outer peripheral surface 210, and a place 203 at a center of the outer peripheral surface 210. The float 200 is attached to the cylindrical portion 110 from both the front surface side and the back surface side of the lane rope float body 100, but the present invention is not limited to this configuration. The float 200 may be attached to only one of the front surface side and the back surface side to make a difference in softness (level of softness) between the front surface side and the back surface side of the lane rope float 300. The cylindrical portion 110 to which the float 200 is attached is integrally molded with the entire lane rope float body 100, but the present invention is not limited to this configuration. A separate cylindrical portion may be attached inside to attach the float 200 having an outer peripheral surface softer than the cylindrical portion to the lane rope float body 100. In this case, the cylindrical portion made of polyethylene (PE) may be welded and fixed to the float 200 made of polyethylene (PE) which is the same material.

The rope R is inserted through the cylindrical portion 110 of the lane rope float 300 to attach the lane rope float 300 to the rope R. In practice, the rope R is inserted through and attached to the plurality of lane rope floats 300 to define lanes of a pool. Then, the lane rope float 300 dissipates waves created by a swimmer in each lane so as not to pass to the adjacent lane.

Further, according to the lane rope float 300 of the present invention, even when a hand or a foot of a swimmer collides with the outer peripheral wall 130A, the outer peripheral wall 130A is elastically deformed inward so as to crush the groove portion 160A (see an arrow F1 in FIG. 4 (*a*)) as illustrated in FIG. 4 (*a*), and the blade 120A is also deformable. Therefore, it is possible to absorb the force at the time of collision and prevent the swimmer from being injured.

Further, the outer peripheral wall 130A deformed inward so as to crush the groove portion 160A eventually abuts on the blade 120A to also deform the blade 120A inward. Then, the outer peripheral wall 130A can be further deformed inward by the deformation of the blade 120A, and, as a result, the force at the time of collision can be more effectively absorbed, and the swimmer can be prevented from being injured.

In addition, conventional lane rope floats may break and be damaged at the time of winding-up or installation of the lane rope, and a person may be injured by touching the damaged portion. However, according to the lane rope float 300 of the present invention, since the outer peripheral wall 130A is elastically deformed inward, the entire portion is soft and is less likely to be damaged, so that injuries can be prevented.

Furthermore, the blade 120A is formed obliquely with respect to the outer peripheral wall 130A, and thus, when the deformed outer peripheral wall 130A abuts on and directly presses the blade 120A, the blade 120A is easily deformed together with the outer peripheral wall 130A. Therefore, even when abutting on the blade 120A, the outer peripheral wall 130A can be elastically deformed further inward from that position. Alternatively, even when the deformed outer peripheral wall 130A presses the blade 120A without abutting thereon, the blade 120A is easily deformed. As a result, the effect of preventing injuries is further enhanced.

In addition, the groove portion 160A is formed between the side end portion 121A of the blade 120A and the outer peripheral wall 130A as illustrated in FIG. 4 (*b*), and thus the blade 120A can be easily elastically deformed. Therefore, even when a hand or a foot of a swimmer collides with the blade 120A (see an arrow F2 in FIG. 4 (*b*)), the blade 120A is elastically deformed so as to fall to a side opposite to the collided side to absorb the force at the time of collision, thereby making it possible to prevent the swimmer from being injured.

In addition, a total of six blades 120A and a total of six blades 120B are provided on the front surface side and the back surface side of the lane rope float 300, respectively, but the present invention is not limited to this configuration. For example, an odd number of blades such as five blades or other arbitrary number of blades may be provided. However, when an even number of blades are provided on each of the front surface side and the back surface side of the lane rope float, the lane rope float can be stably floated in water in a well-balanced manner. In particular, when lanes of a pool are defined, the plurality of lane rope floats arranged continuously can be stably floated at the same position. Since the blades are parallel to the water surface and the adjacent lane rope floats can be floated at the same position, the appearances of the plurality of lane rope floats arranged continuously can be aligned in the same direction. Therefore, the cut portions, which are portions from which waves enter the lane rope floats, are regularly arranged, and the waves are easily taken in, so that the waves are easily dissipated.

Embodiment 2

Figure 5:
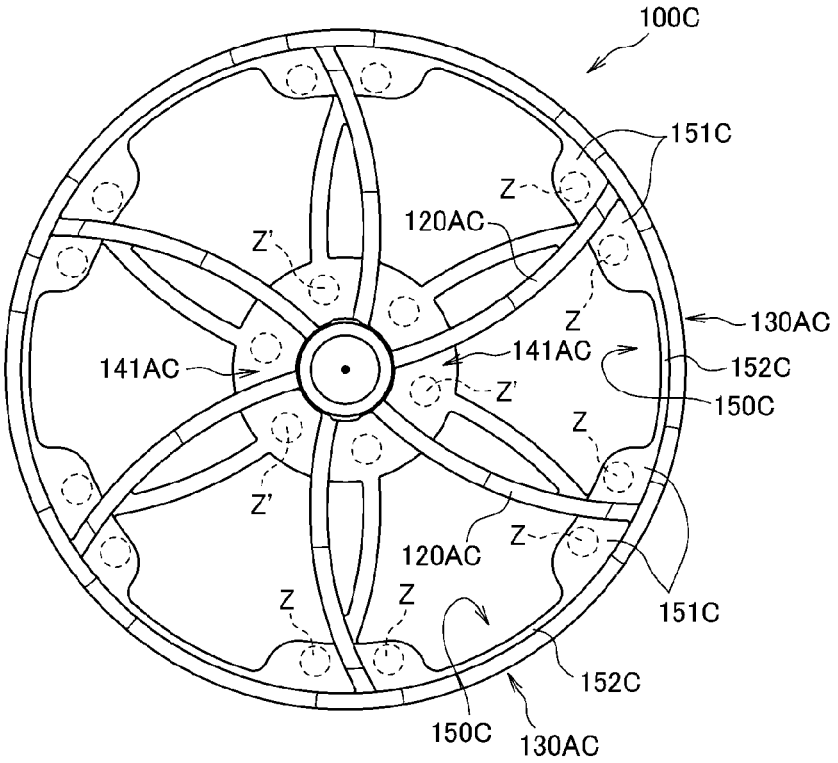
FIG. 5 is a front view of a lane rope float body of a lane rope float according to Embodiment 2 of the present invention.

Next, a lane rope float body 100C of a lane rope float according to Embodiment 2 of the present invention is illustrated in FIG. 5. FIG. 5 is a front view of the lane rope float body 100C of the lane rope float. In addition, the lane rope float according to Embodiment 2 differs from the lane rope float 300 according to Embodiment 1 as illustrated in FIGS. 1 to 4 only in the configuration of an inner connection portion 150C, and is the same as the lane rope float 300 according to Embodiment 1 in the other configurations, and thus detailed descriptions thereof will be omitted.

As illustrated in FIG. 5, the lane rope float body 100C is provided with inner connection portions 150C on an inner side of the outer peripheral wall 130AC, and the inner connection portions 150C each include a wide portion 151C and a narrow portion 152C narrower than the wide portion 151C. The narrow portion 152C is disposed between adjacent blades 120AC and is a portion connecting the wide portions 151C on both sides. The wide portion 151C connected to the blade 120AC is a portion where a protruding pin of a mold for manufacturing the lane rope float body 100C is disposed, and must be made larger than a diameter of a tip of the protruding pin (see circles Z indicated by a broken line in FIG. 5). On the other hand, no protruding pin of the mold is disposed in the narrow portion 152C, and thus the narrow portion 152C can be made smaller than the diameter of the tip of the protruding pin (see the circles Z indicated by a broken line in FIG. 5). As described above, since the inner connection portion 150C includes the narrow portion 152C, the entire inner connection portion 150C is easily deformed, and the outer peripheral wall 130AC is more easily bent.

In order to make it easy to release the lane rope float body 100C from the mold, a surface portion of the mold on which the protruding pin is disposed may be added to the inner side of the outer peripheral wall 130AC between the wide portions 151C on both sides to increase the number of places where the protruding pins of the mold are disposed. Further, when the narrow portion 152C is completely eliminated with the wide portion 151C left, and the adjacent wide portions 151C are made independent from each other, the inner connection portion 150C is more easily deformed, and the outer peripheral wall 130AC is more easily bent. In addition, by forming the wide portion 151C and the narrow portion 152C to be entirely or partially thin, by forming a groove in the whole or a part of the wide portion 151C and the narrow portion 152C, by forming the wide portion 151C and the narrow portion 152C to be partially narrow, or by forming a hole in the wide portion 151C and the narrow portion 152C, the inner connection portion 150C is more easily deformed. The tip of the protruding pin (see circles Z' indicated by a broken line in FIG. 5) may be additionally disposed in a flange portion 141AC. The flange portion 141AC is connected to a plurality of surrounding members and thus has high rigidity, and the protruding pin can effectively push out the lane rope float body 100C. In addition, by pushing of the inner connection portion 150C and an end portion of the blade 120AC with a protruding block, by pushing a part or the whole of the end portion of the blade 120AC with a protruding block, or by pushing the end portion of the blade 120AC and the flange portion 141AC with a protruding block, the lane rope float body 100C can be easily released from the mold.

As described above, in the lane rope float body 100C of the lane rope float of the present invention, the inner connection portion 150C is formed on the inner side of the outer peripheral wall 130AC, and the inner connection portion 150C is formed such that, between the adjacent blades 120AC, a width in the vicinity of the center (see a place where the narrow portion 152C is located in FIG. 5) is narrower than both end portions (see a place where the wide portion 151C is located in FIG. 5), or there is no rib like the narrow portion 152C in the vicinity of the center. Therefore, the outer peripheral wall 130AC is easily elastically deformed inward, and it is possible to prevent the swimmer from being injured even when a hand, a foot, or the like of a swimmer collides with the lane rope float.

Embodiment 3

Figure 6:
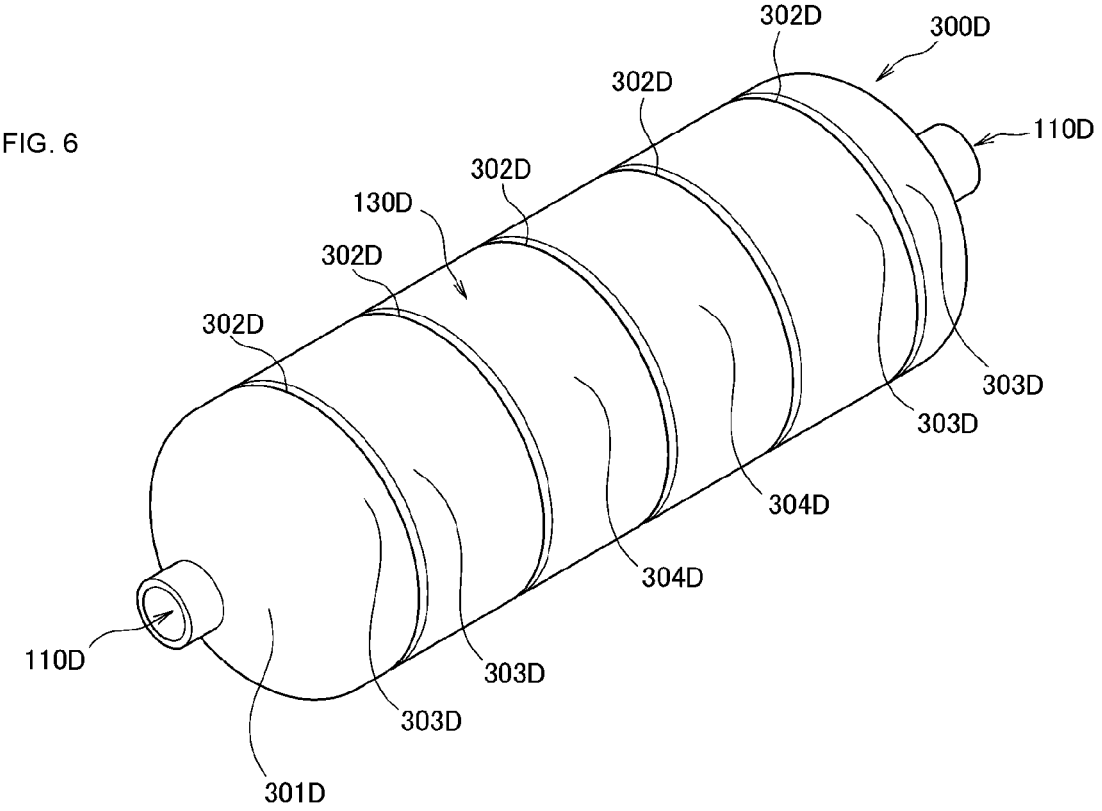
FIG. 6 is an overall perspective view of a lane rope float according to Embodiment 3 of the present invention.

Next, a lane rope float 300D according to Embodiment 3 of the present invention is illustrated in FIG. 6. FIG. 6 is an overall perspective view of the lane rope float 300D.

As illustrated in FIG. 6, the lane rope float 300D is a hollow columnar body, and includes a cylindrical portion 110D through which the rope R can be inserted at the center. The lane rope float 130D has a hollow inside, and thus can float on the water surface. An outer peripheral wall 130D of the lane rope float 300D is configured to be elastically deformable inward. The lane rope float 300D is not limited to the columnar body shape, and may have any shape.

Further, the lane rope float 300D is blow-molded using a synthetic resin material. In the present embodiment, an EVA resin (ethylene-vinyl acetate copolymer resin), polyethylene, LDPE (low density polyethylene), L-LDPE (linear low density polyethylene), metallocene polyethylene, polypropylene, elastomer, styrene elastomer, silicon, or the like is used as the synthetic resin material constituting the lane rope float body 300D, but the present invention is not limited to this configuration. Any synthetic resin material can be appropriately adopted as long as the lane rope float body 300D can be elastically deformed. The lane rope float 300D is blow-molded using a synthetic resin material, but the present invention is not limited to this configuration. The lane rope float 300D may be manufactured by injection molding. Further, unevennesses may be formed on the outer peripheral wall 130D of the lane rope float 300D to increase or decrease the bending strength. Further, the compressive strength of the lane rope float 300D is lower in the order of a place 301D near the cylindrical portion 110D of the outer peripheral wall 130D, a place 303D on both sides of a concave portion 302D on an end side of the outer peripheral wall 130D, and a place 304D between the concave portions 302D on a central side of the outer peripheral wall 130D. A thickness of the lane rope float 300D may be gradually increased from the one cylindrical portion 110D to the other cylindrical portion 110D. In this case, the thicker the cylindrical portion 110D is softer in the order of places on both sides of the concave portion 302D and a place near the cylindrical portion 110D; places on both sides of the concave portion 302D of the thinner cylindrical portion 110D and a place near the cylindrical portion 110D; and a place between the concave portions 302D. Further, the place near the cylindrical portion 110D or the place between the concave portions 302D is softer than the places on both sides of the concave portion 302D. The entire lane rope float 300D is soft, but partially has a difference in softness. Therefore, even when the lane rope float 300D loses its shape due to maintenance of its shape or storage, the lane rope float 300D is stretched in a pool, so that the lane rope float 300D is restored to its original shape. The cylindrical portion 110D is integrally molded with the entire lane rope float 300D, but the present invention is not limited to this configuration. A separate cylindrical portion may be attached inside to make the outer peripheral wall 130D softer than the cylindrical portion. In this case, a cylindrical portion made of polyethylene (PE) may be welded and fixed to the lane rope float 300D.

When a hand, a foot, or the like of a swimmer collides with the lane rope float 300D, the lane rope float 300D is desirably made of a soft synthetic resin material in order that the outer peripheral wall 130D of the lane rope float 300D is easily elastically deformed to prevent injuries.

Therefore, the inventors of the present invention have found optimum hardness at which the lane rope float 300D is easily elastically deformed, through repeated experiments. That is, when hardness of the lane rope float 300D as measured by the durometer type A is in the range of 10 to 95, the lane rope float 300D is easily elastically deformed, and, even when a hand, a foot, or the like of a swimmer collides with the lane rope float 300D, it is possible to prevent the swimmer from being injured.

When the hardness of the lane rope float 300D as measured by the durometer type A is in the range of 75 to 95 (more preferably, the hardness is in the range of 50 to 95), the lane rope float 300D can be easily elastically deformed, and injuries can be effectively prevented. Furthermore, it is possible to effectively prevent a manufacturing problem that the lane rope float 300D is not well separated from a mold at the time of injection molding or blow molding, and a management problem that the lane rope float 300D loses its shape at the time of storage after molding. The lane rope float 300D may be stored in a state in which the lane rope is wound up or the lane rope float 300D is packed in a storage box.

Furthermore, when the hardness of the lane rope float 300D as measured by the durometer type A is in the range of 40 to less than 75, the lane rope float 300D can be easily elastically deformed, and injuries can be effectively prevented. Further, it is possible to effectively prevent a manufacturing problem that the lane rope float 300D is not well separated from the mold at the time of injection molding or blow molding.

Furthermore, when the hardness of the lane rope float 300D as measured by the durometer type A is in the range of 10 to less than 40, the lane rope float 300D can be easily elastically deformed, and injuries can be effectively prevented.

In a case where the lane rope float 300D is manufactured using an elastomer, when the hardness of the lane rope float 300D is in the range of 20 to 95, the lane rope float 300D can be easily elastically deformed, and injuries can be effectively prevented. Furthermore, it is possible to effectively prevent a manufacturing problem that the lane rope float 300D is not well separated from a mold at the time of injection molding or blow molding, and a management problem that the lane rope float 300D loses its shape at the time of storage after molding. In a case where the lane rope float 300D is manufactured using an elastomer, when the hardness of the lane rope float 300D is low, a method of manually releasing the lane rope float 300D from the mold at the time of injection molding or blow molding may be adopted. In addition, when the lane rope float 300D is stored in a state of being wound around a reel, the lane rope float 300D is elastically deformed to lose its shape, and a diameter when wound around the reel is reduced, so that a storage space can be reduced. In a case where the lane rope float 300D is reused, when the lane rope float 300D is removed from the reel and stretched in a pool, the lane rope float 300D is restored to its shape (including a case where the lane rope float 300D is restored to its original shape as compared with a case where the lane rope float 300D is stored in a state of being wound around a reel, although the lane rope float 300D may not be completely restored to its original shape).

In a case where the lane rope float 300D is manufactured using a styrene-based elastomer, the hardness of the lane rope float 300D is 15. In a case where the lane rope float body is manufactured using silicon, the hardness thereof is 13. However, if the hardness of the lane rope float 300D is less than 10, the lane rope float 300D is not well separated from the mold at the time of injection molding or blow molding and loses its shape during storage thereof after molding.

The hardness of the lane rope float 300D described above is obtained by cutting out a part of the lane rope float 300D (for example, an arbitrary place such as the outer peripheral wall 130D) after molding as a test piece, and measuring the hardness of the test piece by the durometer type A in accordance with JIS K6253-3.

In addition, when a bending elastic modulus (unit: MPa) of the lane rope float 300D is in the range of 10 to 200, preferably in the range of 30 to 120, it is possible to more effectively prevent a manufacturing problem that the lane rope float 300D is not well separated from the mold at the time of injection molding or blow molding, and a management problem that the lane rope float 300D loses its shape at the time of storage after molding. Further, the lane rope float 300D is easily elastically deformed, and, even when a hand, a foot, or the like of a swimmer collides with the lane rope float 300D, it is possible to prevent the swimmer from being injured. The bending elastic modulus of the lane rope float 300D was measured by a test method in accordance with JIS K6924-2.

In addition, when the lane rope float 300D is compressed from the outside of the outer peripheral wall toward the center, when compressive strength when the diameter of the lane rope float 300D is compressed by 5 mm (or 4.6%) is 100N (kg·m/s2) or less, preferably 50N or less, more preferably 30N or less, the lane rope float 300D is easily elastically deformed, and, even when a hand, a foot, or the like of a swimmer collides with the lane rope float 300D, it is possible to prevent the swimmer from being injured.

As described above, according to the lane rope float 300D of the present invention, even when a hand or a foot of a swimmer collides with the outer peripheral wall 130D, the outer peripheral wall 130D is elastically deformed inward to absorb the force at the time of collision, thereby making it possible to prevent the swimmer from being injured. Further, when hardness of the lane rope float 300D as measured by the durometer type A is set in the range of 10 to 95, the lane rope float 300D is easily elastically deformed, and, even when a hand, a foot, or the like of a swimmer collides with the lane rope float 300D, it is possible to prevent the swimmer from being injured.

In addition, conventional lane rope floats may break and be damaged at the time of winding-up or installation of the lane rope, and a person may be injured by touching the damaged portion. However, according to the lane rope float 300D of the present invention, since the outer peripheral wall 130D is elastically deformed inward, the entire portion is soft and is less likely to be damaged, so that injuries can be prevented.

Embodiment 4

Figure 7:
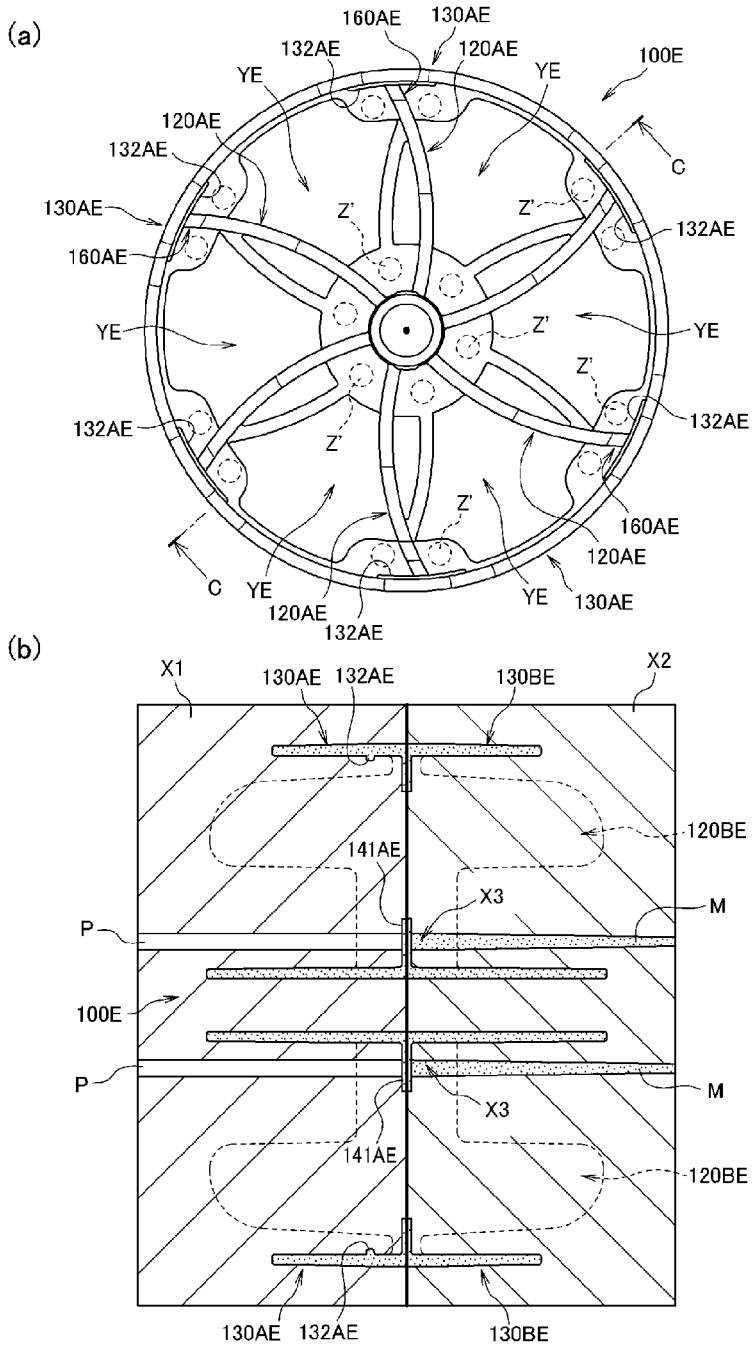
FIG. 7 (*a*) is a front view of a lane rope float body according to Embodiment 4 of the present invention, and FIG. 7 (*b*) is a cross-sectional view taken along line C-C of FIG. 7 (*a*), and is a schematic cross-sectional view illustrating a movable-side mold and a fixed-side mold.

Next, a lane rope float body 100E of a lane rope float according to Embodiment 4 of the present invention is illustrated in FIG. 7. FIG. 7 (*a*) is a front view of the lane rope float body 100E, and FIG. 7 (*b*) is a cross-sectional view taken along line C-C of FIG. 7 (*a*), and is a schematic cross-sectional view illustrating a movable-side mold and a fixed-side mold. In addition, the lane rope float body 100E according to Embodiment 4 differs from the lane rope float body 100C according to Embodiment 2 illustrated in FIG. 5 only in that it includes a protrusion 132AE, and is the same as the lane rope float body 100C according to Embodiment 2 in the other configurations, and thus, detailed descriptions thereof will be omitted.

As illustrated in FIG. 7 (*a*), the protrusion 132AE protruding toward a groove portion 160AE is provided on an inner surface of an outer peripheral wall 130AE. The protrusion 132AE extends in a circumferential direction of the lane rope float body 100E across the groove portion 160AE along an inner side of the outer peripheral wall 130AE. As illustrated in FIG. 7 (*b*), when the injection-molded lane rope float body 100E is removed from the mold, the lane rope float body 100E is attached to a movable-side mold (core) X1 side.

Specifically, a molten synthetic resin material M is poured into a gap between the movable-side mold (core) X1 and a fixed-side mold (cavity) X2 for manufacturing the lane rope float body 100E by applying pressure via a gate X3. Then, as illustrated in FIG. 7 (*b*), the lane rope float body 100E made of an injection-molded body of the synthetic resin material M is manufactured, and, after it is cooled and solidified, the movable-side mold X1 and the fixed-side mold X2 move in a direction of separating from each other, and the lane rope float body 100E is taken out from the molds.

Then, since the protrusion 132AE of the lane rope float body 100E is caught by the movable-side mold (core) X1, the lane rope float body 100E remains attached to the movable-side mold X1 and is detached from the fixed-side mold X2 when the movable-side mold X1 and the fixed-side mold X2 move in the direction of separating from each other. Next, when a flange portion 141AE of the lane rope float body 100E is pushed out toward the fixed-side mold X2 by a protruding pin P incorporated in the movable-side mold X1, the lane rope float body 100E is detached from the movable-side mold X1. In this manner, by keeping the lane rope float body 100E attached to the movable-side mold X1 by the protrusion 132AE, the lane rope float body 100E can be reliably pushed out from the movable-side mold X1 by the protruding pin P and can be completely removed. In particular, in the present invention, since the lane rope float body 100E is manufactured using a soft synthetic resin material, the lane rope float body 100E can be successfully removed from the mold, and the manufacturing thereof is facilitated.

When the lane rope float body 100E is taken out from the movable-side mold X1, air may be injected between the movable-side mold X1 and the lane rope float body 100E. Further, each of the movable-side mold X1 and the fixed-side mold X2 illustrated in FIG. 7 (*b*) is an integrated single mold, but the present invention is not limited to this configuration. Six divided molds disposed in six spaces YE (see FIG. 7 (*a*)), respectively, of the lane rope float body 100E may be adopted. In FIG. 7, the movable-side mold X1 and the fixed-side mold X2 constitute a mold divided into two. However, the present invention is not limited to this configuration. In order to facilitate demolding of the lane rope float body 100E, a mold divided into upper, lower, left, and right four sides may be configured.

In order to easily remove the lane rope float body or the lane rope float of the present invention from the mold, the blade or the outer peripheral wall, the blade and an inner surface of the outer peripheral wall, both the blade and the outer peripheral wall, both an outer surface of the cylindrical portion and the inner surface of the outer peripheral wall, or outer surfaces of the blade and the cylindrical portion and the inner surface of the outer peripheral wall may be subjected to embossing (processing to make the surface rough without polishing the surface). Further, the outer surface of the outer peripheral wall may not be embossed, and only the inner surface thereof may be embossed. Further, the embossing applied to the inner surface of the outer peripheral wall may be finer than that applied to the outer surface thereof. Further, the entire lane rope float body or the entire lane rope float may be embossed. In addition, air may be injected between the mold and the lane rope float body or the lane rope float so that the lane rope float body or the lane rope float is easily separated from the mold during injection molding or blow molding.

Embodiment 5

Figure 8:
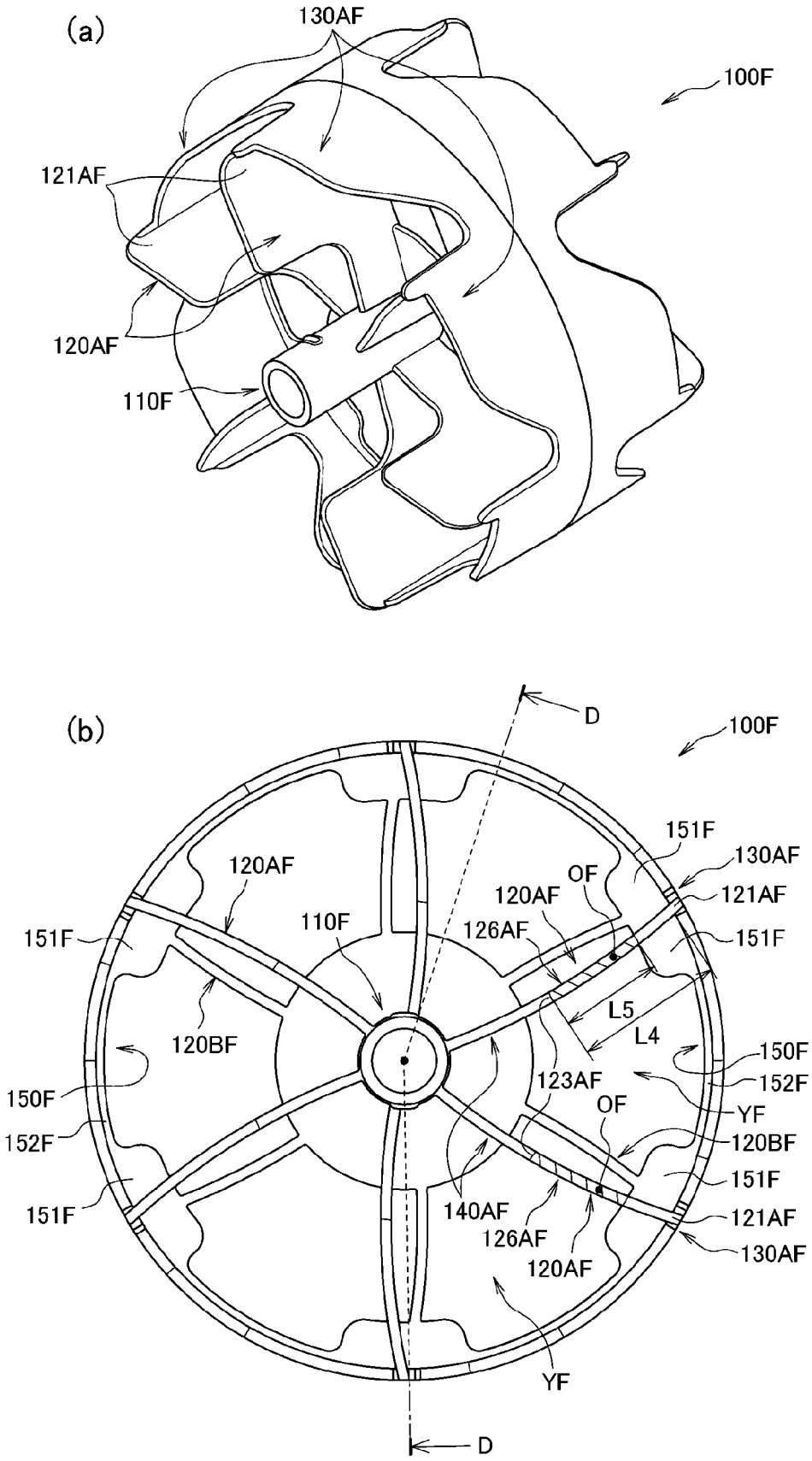
FIG. 8 (*a*) is an overall perspective view of a lane rope float body according to Embodiment 5 of the present invention, and FIG. 8 (*b*) is a front view of the lane rope float body.
Figure 9:
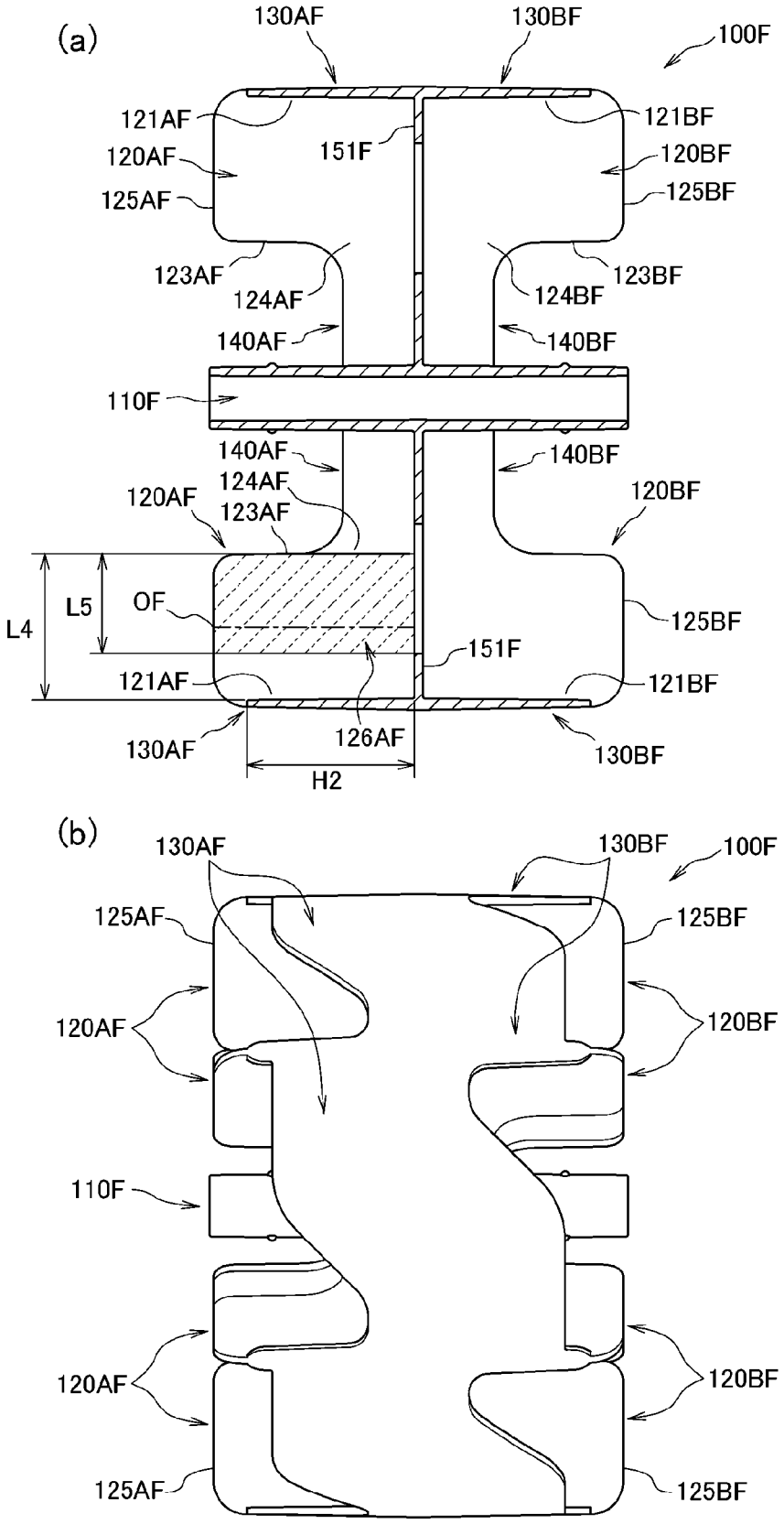
FIG. 9 (*a*) is a cross-sectional view taken along line D-D of FIG. 8 (*b*), and FIG. 9 (*b*) is a side view of the lane rope float body.

Next, a lane rope float body 100F of a lane rope float according to Embodiment 5 of the present invention is illustrated in FIGS. 8 and 9. FIG. 8 (*a*) is an overall perspective view of the lane rope float body 100F, FIG. 8 (*b*) is a front view of the lane rope float body 100F, FIG. 9 (*a*) is a cross-sectional view taken along line D-D of FIG. 8 (*b*), and FIG. 9 (*b*) is a side view of the lane rope float body 100F. In addition, the lane rope float according to Embodiment 5 differs from the lane rope float 300 according to Embodiment 1 as illustrated in FIGS. 1 to 4 only in the configurations of blades 120AF and blades 120BF, and an inner connection portion 150F, and is the same as the lane rope float 300 according to Embodiment 1 in the other configurations, and thus detailed descriptions thereof will be omitted. In addition, since the configuration of the inner connection portion 150F of the lane rope float body 100F is the same as the configuration of the inner connection portion 150C of the lane rope float body 100C according to Embodiment 2 illustrated in FIG. 5, detailed descriptions thereof will be omitted.

As illustrated in FIGS. 8 and 9, side end portions 121AF of the blades 120AF of the lane rope float body 100F are connected to an outer peripheral wall 130AF, but, unlike the lane rope float body 100 of the lane rope float 300 according to Embodiment 1, no groove portions 160A are formed between the side end portions 121AF of the blades 120AF and the outer peripheral wall 130AF. That is, as illustrated in FIG. 9 (*a*), the outer peripheral wall 130AF and the side end portion 121AF of each of the blades 120AF are directly connected over the entire height H2 direction of the outer peripheral wall 130AF.

Therefore, a part of the waves having entered the lane rope float body 100F is efficiently confined in a space surrounded by the blade 120AF and the outer peripheral wall 130AF without escaping from the groove portion, is effectively dissipated. Even when the groove portion is present, a part of the waves having entered the lane rope float body only circulates within the lane rope float body via the groove portion, and the waves having entered the lane rope float body are still confined in the lane rope float body. Therefore, the lane rope float body has wave dissipating performance.

Further, as illustrated in FIG. 9, an end portion 125AF on a front side of the blade 120AF is formed in a linear shape. Therefore, when the rope is inserted through cylindrical portions 110F of the plurality of lane rope float bodies 100F and the plurality of lane rope float bodies 100F are continuously arranged to define lanes of a pool, a gap between the adjacent lane rope float bodies 100F can be narrowed. Specifically, since the end portion 125AF on the front side of the blade 120AF is linear, the blades 120AF of the adjacent lane rope float bodies 100F can be extremely brought close to each other without interfering with each other, so that the gap between the adjacent lane rope float bodies 100F can be extremely narrowed. The waves that have entered the lane rope float body 100F hardly escape to the outside from the gap between the adjacent lane rope float bodies 100F, and wave dissipating performance is improved. When the blade 120AF may be formed to be long such that the end portion 125AF on the front side of the blade 120AF protrudes from an end portion of the cylindrical portion 110F, and the plurality of lane rope float bodies 100F are continuously arranged to define lanes of a pool, the blades of the adjacent lane rope float bodies 100F may interfere with each other. Even when the blade 120AF is formed to be long and the blades of the adjacent lane rope float bodies 100F interfere with each other, the adjacent blades hit each other, thereby improving wave dissipating performance.

As illustrated in FIGS. 8 and 9, an inner end portion 123AF of each of the blades 120AF is connected to the cylindrical portion 110F via a central connection portion 140AF. The adjacent blades 120AF are connected to each other by a wide portion 151F of the inner connection portion 150F on the side end portion 121AF side. Therefore, in the blade 120AF, a non-connection portion 126AF where the adjacent blades 120AF are not connected to each other is a portion from the inner end portion 123AF to the wide portion 151F (see hatched portions in FIG. 8 (*a*) and a dotted portion in FIG. 9 (*a*)).

A length of the blade 120AF in a direction from the cylindrical portion 110F side toward the outer peripheral wall 130AF (in other words, in a radial direction of the lane rope float body 100F) is a length L4 from the inner end portion 123AF to the side end portion 121AF, and a length of the non-connection portion 126AF in a direction from the cylindrical portion 110F side toward the outer peripheral wall 130AF is a length L5 from the inner end portion 123AF to the wide portion 151F. The length L5 of the non-connection portion 126AF is half or more of the length L4 of the blade 120AF. Further, the non-connection portion 126AF extends from the inner end portion 123AF side toward the wide portion 151F side across a center of the length L4 of the blade 120AF, that is, a center OF of the blade 120AF.

As described above, the length L5 of the non-connection portion 126AF of the blade 120AF is half or more of the length L4 of the blade 120AF, and the non-connection portion 126AF extends across the center OF of the blade 120AF, so that most of the vicinity of the center of the blade 120AF is not connected to the adjacent blades 120AF. Therefore, the blade 120AF is easily elastically deformed.

Furthermore, as illustrated in FIG. 8 (*b*), the space YF is provided between the adjacent blades 120AF along the non-connection portion 126AF. Since the space YF is provided along the non-connection portion 126AF, there is no portion connecting the adjacent blades 120AF in the space YF. In addition to the fact that the blades 120AF are easily elastically deformed as described above, the space YF exists between the adjacent blades 120AF, and thus the outer peripheral wall 130AF can be easily elastically deformed inward so as to crush the space YF. As a result, even when a hand or a foot of a swimmer collides with the outer peripheral wall 130AF, the outer peripheral wall 130AF is elastically deformed inward so as to crush the space YF and absorbs the force at the time of collision, thereby making it possible to prevent the swimmer from being injured.

Furthermore, the blade 120AF is formed obliquely with respect to the outer peripheral wall 130AF, and thus, when the deformed outer peripheral wall 130AF presses the blade 120AF, the blade 120AF is easily deformed together with the outer peripheral wall 130AF. Therefore, even when pressing the blade 120AF, the outer peripheral wall 130AF can be elastically deformed further inward from that position. Alternatively, when the outer peripheral wall 130AF is elastically deformed inward, the blade 120AF is elastically deformed toward the adjacent blade 120AF. As a result, the outer peripheral wall 130AF is easily elastically deformed inward, and even when a hand, a foot, or the like of a swimmer collides with the lane rope float, it is possible to prevent the swimmer from being injured.

Embodiment 6

Figure 10:
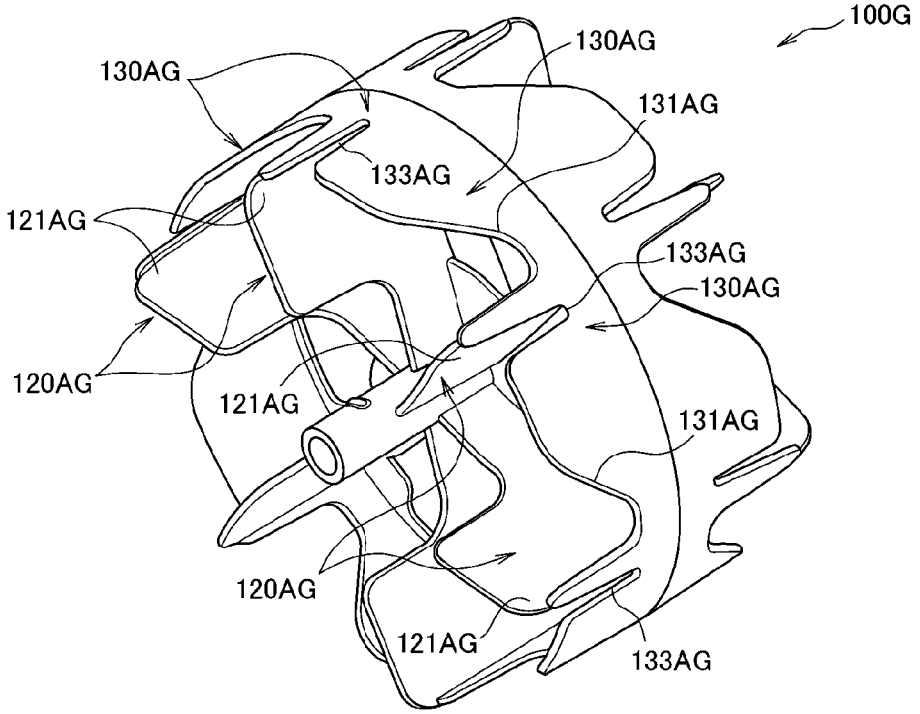
FIG. 10 (*a*) is an overall perspective view of a lane rope float body according to Embodiment 6 of the present invention, and FIG. 10 (*b*) is a side view of the lane rope float body.
Figure 10:
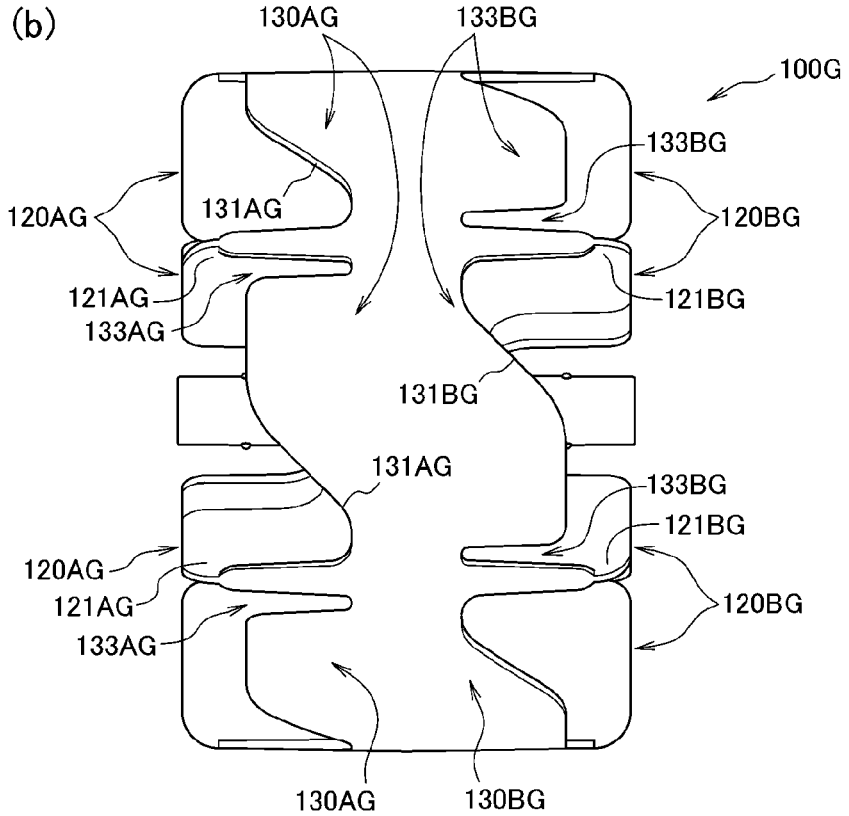

Next, a lane rope float body 100G of a lane rope float according to Embodiment 6 of the present invention is illustrated in FIG. 10. FIG. 10 (*a*) is an overall perspective view of the lane rope float body 100G, and FIG. 10 (*b*) is a side view of the lane rope float body 100G. In addition, the lane rope float body 100G according to Embodiment 6 differs from the lane rope float body 100F according to Embodiment 5 illustrated in FIG. 8 only in the configuration of an outer peripheral wall 130AG, and is the same as the lane rope float body 100F according to Embodiment 5 in the other configurations, and thus detailed descriptions thereof will be omitted.

As illustrated in FIG. 10, the outer peripheral wall 130AG is connected to side end portions 121AG of blades 120AG, but a groove portion 133AG is provided in a portion on a lateral side of the side end portion 121AG of each of the blades 120AG. Therefore, the outer peripheral wall 130AG is more easily elastically deformed toward the center of the lane rope float body 100G. Even when a hand or a foot of a swimmer collides with the outer peripheral wall 130AG, the outer peripheral wall 130AG is elastically deformed inward and absorbs the force at the time of collision. Therefore, it is possible to prevent the swimmer from being injured.

Further, a cut portion 131AG cut obliquely is formed in the outer peripheral wall 130AG between the adjacent blades 120AG. The outer peripheral wall 130AG is more easily elastically deformed by the cut portion 131AG. In addition, since the cut portions 131AG and the groove portions 133AG are provided in portions on both lateral sides of the side end portion 121AG of the blade 120AG, the blade 120AG itself is further easily elastically deformed.

When the blade 120AG is positioned in the cut portion 131AG of the outer peripheral wall 130AG, the side end portion 121AG of the blade 120AG is exposed to the outside from the cut portion 131AG. Then, the blade 120AG exists in the cut portion 131AG of the outer peripheral wall 130AG, and thus the outer peripheral wall 130AG itself is easily elastically deformed. Further, since the side end portion 121AG of the blade 120AG is exposed, the blade 120AG itself is also easily elastically deformed.

Embodiment 7

Figure 11:
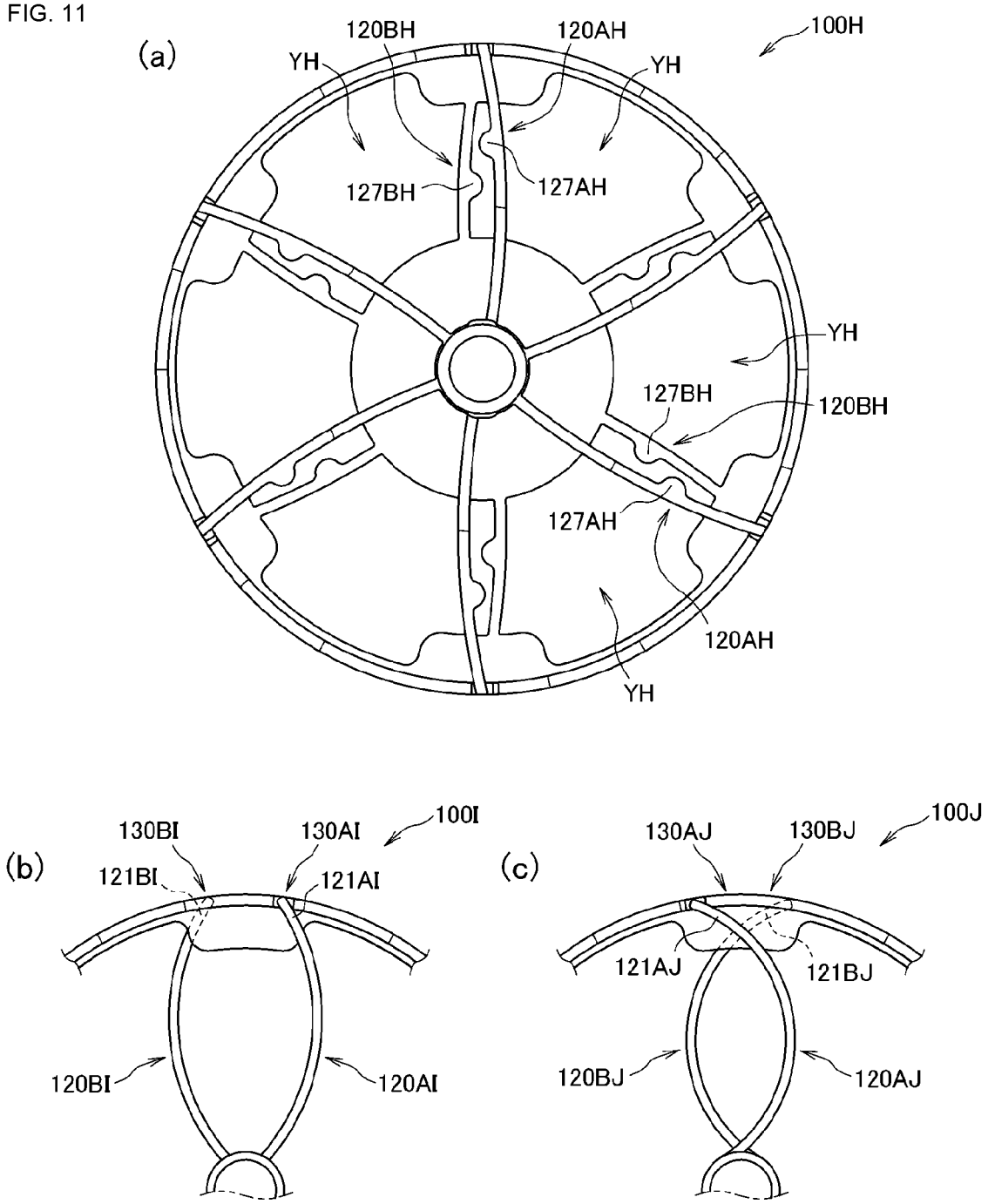
FIG. 11 (*a*) is a front view of a lane rope float body according to Embodiment 7 of the present invention, FIG. 11 (*b*) is a front view of a lane rope float body according to Embodiment 8 of the present invention in which a periphery of a blade is enlarged, and FIG. 11 (*c*) is a front view of a lane rope float body according to Embodiment 9 of the present invention in which a periphery of a blade is enlarged.

Next, FIG. 11 (*a*) shows a lane rope float body 100H of a lane rope float according to Embodiment 7 of the present invention. FIG. 11 (*a*) is a front view of the lane rope float body 100H. In addition, the lane rope float body 100H according to Embodiment 7 differs from the lane rope float body 100F according to Embodiment 5 illustrated in FIG. 8 only in that blades 120AH and blades 120BH include convex portions 127AH and convex portions 127BH, respectively, and is the same as the lane rope float body 100F according to Embodiment 5 in the other configurations, and thus detailed descriptions thereof will be omitted.

As illustrated in FIG. 11 (*a*), the convex portion 127AH protruding toward a space YH is formed in each of the blades 120AH on a front surface side. In addition, the convex portion 127BH protruding toward the space YH is formed on each of the blades 120BH on a back surface side. As illustrated in FIG. 11 (*a*), in a state in which the lane rope float body 100H is viewed from the front, the convex portion 127AH and the convex portion 127BH protrude into a gap between the adjacent blade 120AH on the front surface side and the blade 120BH on the back surface side, thereby making it possible to prevent a finger of a swimmer's hand or foot from entering the gap between the blade 120AH and the blade 120BH.

In FIG. 11 (*a*), the convex portion 127AH and the convex portion 127BH are provided on both the blade 120AH and the blade 120BH, respectively, but the present invention is not limited to this configuration. The convex portion may be provided only on one of the blade 120AH and the blade 120BH. Furthermore, in FIG. 11 (*a*), the convex portion has a semicircular shape in order that a finger of a swimmer's hand or foot is less likely to be injured, but the present invention is not limited to this configuration. The convex portion may have any shape as long as the finger of the swimmer's hand or foot is less likely to be injured.

Embodiment 8

Next, FIG. 11 (*b*) shows a lane rope float body 100I of a lane rope float according to Embodiment 8 of the present invention. FIG. 11 (*b*) is a front view of the lane rope float body 100I, and is an enlarged front view of a periphery of a blade 120AI and a blade 120BI. In addition, the lane rope float body 100I according to Embodiment 8 differs from the lane rope float body 100F according to Embodiment 5 illustrated in FIG. 8 only in the positional relationship between the blade 120AI and the blade 120BI, and is the same as those of the lane rope float body 100F according to Embodiment 5 in the other configurations, and thus detailed descriptions thereof will be omitted.

As illustrated in FIG. 11 (*b*), the side end portion 121AI of the blade 120AI on a front surface side and the side end portion 121BI of the blade 120BI on a back surface side are separated from each other and in parallel with each other in a state in which the lane rope float body 100I is viewed from the front. Therefore, an outer peripheral wall 130AI and an outer peripheral wall 130BI illustrated in FIG. 11 (*b*) are easily elastically deformed inward as compared with the case where the side end portion 121A of the blade 120A and the side end portion 121B of the blade 120B overlap each other as illustrated in FIG. 1.

Embodiment 9

Next, FIG. 11 (*c*) shows a lane rope float body 100J of a lane rope float according to Embodiment 9 of the present invention. FIG. 11 (*c*) is a front view of the lane rope float body 100J, and is an enlarged front view of a periphery of a blade 120AJ and a blade 120BJ. In addition, the lane rope float body 100J according to Embodiment 9 differs from the lane rope float body 100F according to Embodiment 5 illustrated in FIG. 8 only in the positional relationship between the blade 120AJ and the blade 120BJ, and is the same as those of the lane rope float body 100F according to Embodiment 5 in the other configurations, and thus detailed descriptions thereof will be omitted.

As illustrated in FIG. 11 (*c*), the side end portion 121AJ of the blade 120AJ on a front surface side and the side end portion 121BJ of the blade 120BJ on a back surface side cross each other in a state in which the lane rope float body 100J is viewed from the front. Therefore, an outer peripheral wall 130AJ and an outer peripheral wall 130BJ illustrated in FIG. 11 (*c*) are easily elastically deformed inward as compared with the case where the side end portion 121A of the blade 120A and the side end portion 121B of the blade 120B overlap each other as illustrated in FIG. 1.

Note that the lane rope float of the present invention is not limited to the above embodiments, and various modifications and combinations are possible within the scope of the claims and the scope of the embodiments. These modifications and combinations are also included in the scope of rights thereof. In addition, the lane rope float of the present invention includes, in the scope of rights, combinations of individual configurations with other configurations, independently of the combinations of configurations described in all the above embodiments.

The invention claimed is:

1. A lane rope float that is attached to a rope via a cylindrical portion to define lanes of a pool and is made of a synthetic resin material, the lane rope float comprising:

a plurality of blades protruding in parallel with the rope around the cylindrical portion; and an outer peripheral wall connected to side end portions of the blades, wherein the blades are each provided with a non-connection portion where the adjacent blades are not connected to each other, the non-connection portion extending across a center of the blade and having a length of half or more of the length of the blade, wherein a space is further provided between the adjacent blades along the non-connection portion, and wherein the outer peripheral wall is elastically deformable so as to crush the space.

2. A lane rope float that is attached to a rope via a cylindrical portion to define lanes of a pool and is made of a synthetic resin material, the lane rope float comprising:

a plurality of blades protruding in parallel with the rope around the cylindrical portion; and an outer peripheral wall connected to side end portions of the blades, wherein a groove portion is formed between the side end portion of each of the blades and the outer peripheral wall, wherein a terminal portion of the side end portion of the blade and the outer peripheral wall is connected, and wherein the outer peripheral wall is elastically deformable toward the blade so as to crush the groove portion.

3. A lane rope float that is attached to a rope via a cylindrical portion to define lanes of a pool and is made of a synthetic resin material, the lane rope float comprising:

a plurality of blades protruding in parallel with the rope around the cylindrical portion; and an outer peripheral wall connected to side end portions of the blades, wherein a groove portion is formed on the outer peripheral wall at a lateral side of the side end portion of each of the blades, and wherein the outer peripheral wall is elastically deformable toward a center.

4. A lane rope float that is attached to a rope via a cylindrical portion to define lanes of a pool and is made of a synthetic resin material, the lane rope float comprising:

a plurality of blades protruding in parallel with the rope around the cylindrical portion; and an outer peripheral wall connected to side end portions of the blades, wherein the blades are each formed obliquely with respect to the outer peripheral wall, and wherein the outer peripheral wall is elastically deformable toward the blade.

5. A lane rope float that is attached to a rope via a cylindrical portion to define lanes of a pool and is made of a synthetic resin material, the lane rope float comprising:

a plurality of blades protruding in parallel with the rope around the cylindrical portion; and an outer peripheral wall connected to side end portions of the blades, wherein an inner connection portion is formed on an inner side of the outer peripheral wall, the inner connection portion being formed such that a width in the vicinity of a center thereof is narrower than both end portions thereof between the adjacent blades, or that the inner connection portion is not formed in the vicinity of the center thereof, and wherein the outer peripheral wall is elastically deformable toward the blades.

6. The lane rope float according to claim 1, wherein the synthetic resin material is soft and has a durometer type A hardness of 10 to 95.

7. A lane rope float attached to a rope to define lanes of a pool and made of a synthetic resin material, the lane rope float comprising:

an outer peripheral wall which is elastically deformable, wherein the synthetic resin material is soft and has a durometer type A hardness of 10 to 95.

8. The lane rope float according to claim 2, wherein the synthetic resin material is soft and has a durometer type A hardness of 10 to 95.

9. The lane rope float according to claim 3, wherein the synthetic resin material is soft and has a durometer type A hardness of 10 to 95.

10. The lane rope float according to claim 4, wherein the synthetic resin material is soft and has a durometer type A hardness of 10 to 95.

11. The lane rope float according to claim 5, wherein the synthetic resin material is soft and has a durometer type A hardness of 10 to 95.

* * * * *